Best Available Copy

United States Patent [19]

Thompson et al.

[11] 4,142,594

[45] Mar. 6, 1979

[54] METHOD AND CORE BARREL APPARATUS FOR OBTAINING AND RETRIEVING SUBTERRANEAN FORMATION SAMPLES

[75] Inventors: Charles M. Thompson, Carrollton, Tex.; Charles W. Spehrley, White River Junction, Vt.; Charles T. Thompson, Dallas, Tex.

[73] Assignee: American Coldset Corporation, Addison, Tex.

[21] Appl. No.: 813,358

[22] Filed: Jul. 6, 1977

[51] Int. Cl.[2] ..... E21B 49/00

[52] U.S. Cl. ..... 175/59; 175/233; 175/243; 251/303

[58] Field of Search ..... 175/42, 46, 236, 317, 175/58, 59, 243, 233, 241, 226, 245, 254, 239, 340, 59; 251/228, 303; 73/425, 425.2, 425.4 R

[56] References Cited

U.S. PATENT DOCUMENTS

| | | | |
|---|---|---|---|
| 164,460 | 6/1875 | Kemper | 175/243 |
| 216,372 | 6/1879 | Botsford | 175/243 |
| 2,287,909 | 6/1942 | Sewell | 175/233 |
| 2,347,726 | 5/1944 | Auld et al. | 175/233 |
| 2,445,494 | 7/1948 | Redmond | 175/59 X |
| 2,734,719 | 2/1956 | Otway | 175/233 |
| 3,323,692 | 6/1967 | Cook | 251/303 X |
| 3,548,958 | 12/1970 | Blackwell | 175/233 |
| 3,714,996 | 2/1973 | Dane, Jr. | 175/245 X |
| 3,874,465 | 4/1975 | Young et al. | 175/243 X |

*Primary Examiner*—Ernest R. Purser
*Assistant Examiner*—Richard E. Favreau
*Attorney, Agent, or Firm*—Kenyon & Kenyon, Reilly, Carr & Chapin

[57] ABSTRACT

Core barrel apparatus and a method for obtaining and retrieving sealed core samples of subterranean formations are disclosed. The core barrel apparatus comprises inner and outer core barrels. The upper portion of the outer core barrel is adapted to be connected to a drill string. A core bit for cutting a core sample is mounted on the lower portion of the outer core barrels. The inner core barrel comprises a sample chamber for receiving a core sample as it is formed at the bottom of a bore hole and an expansion chamber for receiving sample fluids. The sample chamber and expansion chamber are selectively connected to one another. The expansion chamber is sealed closed while the sample is being cut and received within the sample chamber. The lower portion of the sample chamber adjacent the core bit is sealed by a flap-valve which includes a flexible flap member. The flexible flap member is deflected from its normal form of a flat disc into a semi-cylindrical form and stored adjacent to the inner circumference of the sample chamber while the sample is being cut. Once the core sample is within the sample chamber, the flap member is permitted to spring into its flat disc form and extend across the opening in the lower portion of the sample chamber in order to seal the core sample within the chamber. Thereafter the expansion chamber is opened to the sample chamber. As the apparatus is raised toward the surface and the pressure within the bore hole decreases, the expansion chamber expands in response to the pressure of the fluid within it and thereby maintains the pressure within the expansion chamber at or relatively near the bore hole pressure.

40 Claims, 21 Drawing Figures

36
30
32
2
40
82A
122
252
58
56
54
247
52
48
50
246
248
250
46
Enclosing Core Pos.
Lifting With Core
Coring Pos.

Fig. 6.
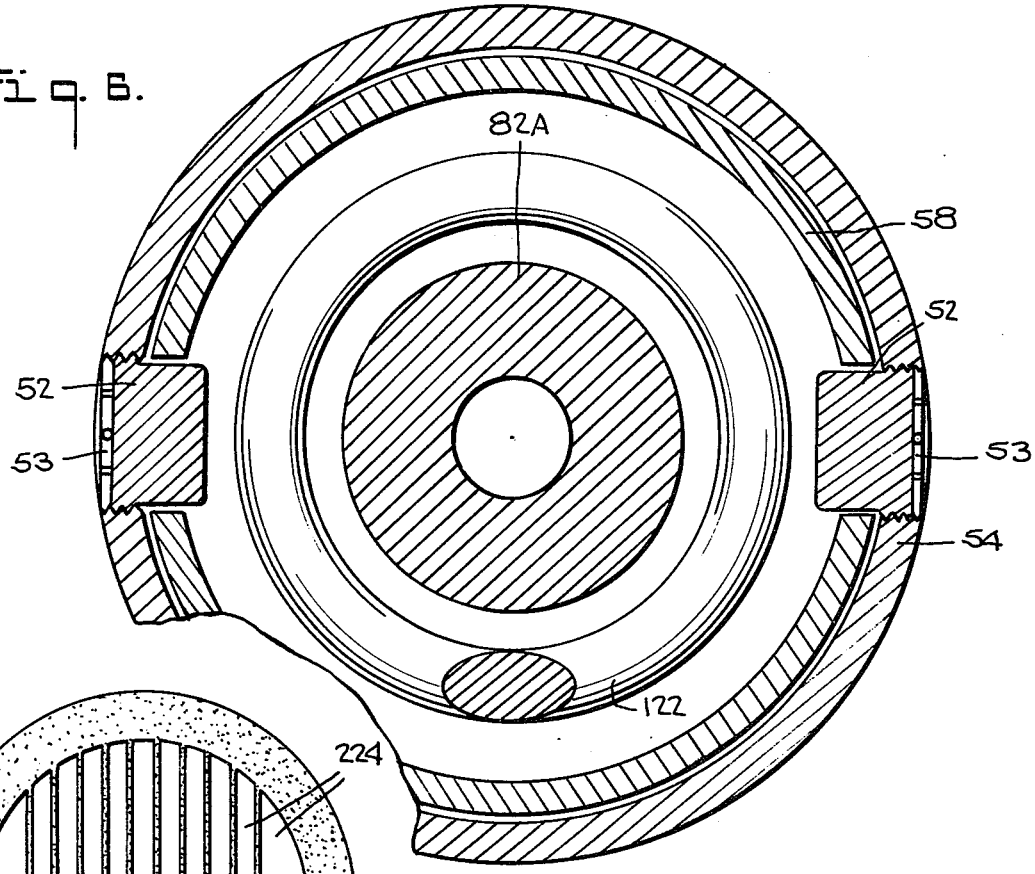
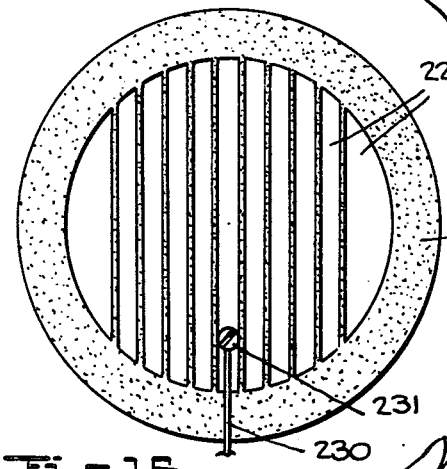
Fig. 15.
Fig. 8.
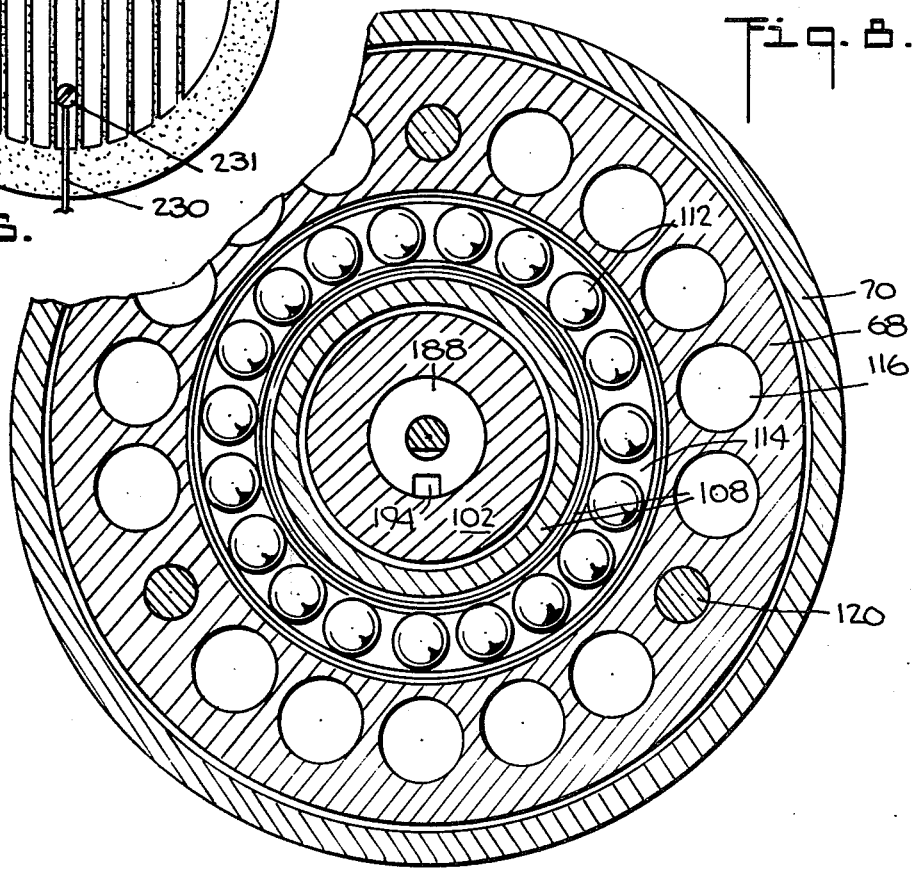

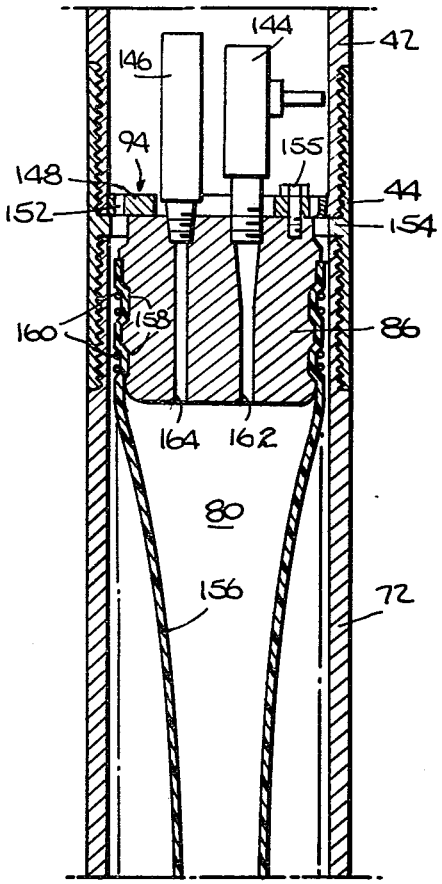
Fig. 7.
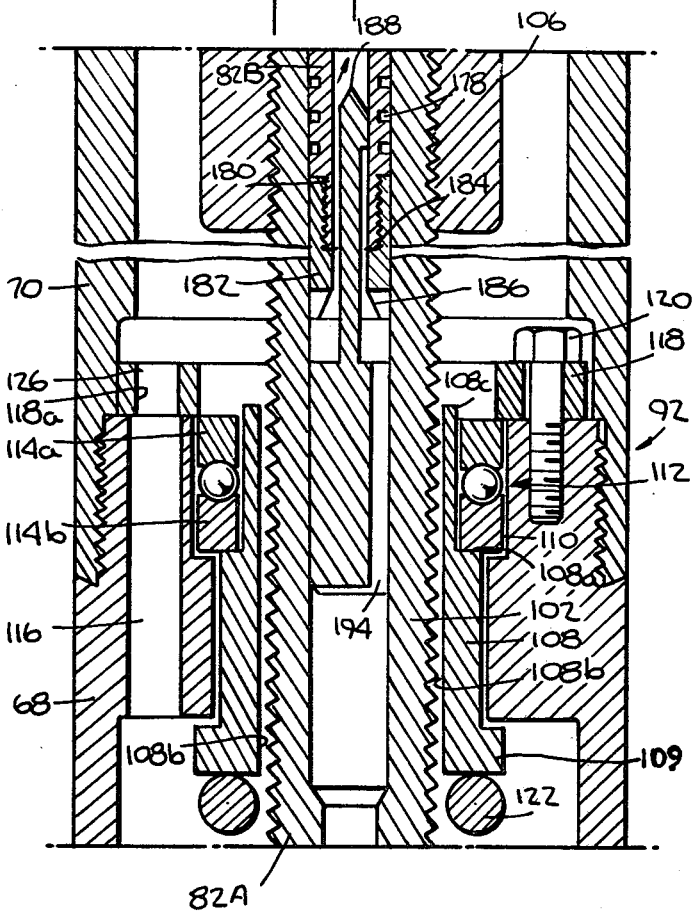
Fig. 11.
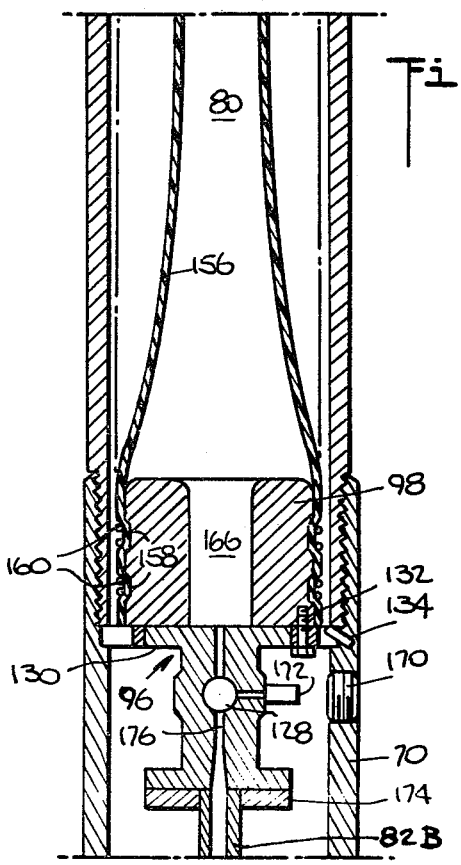
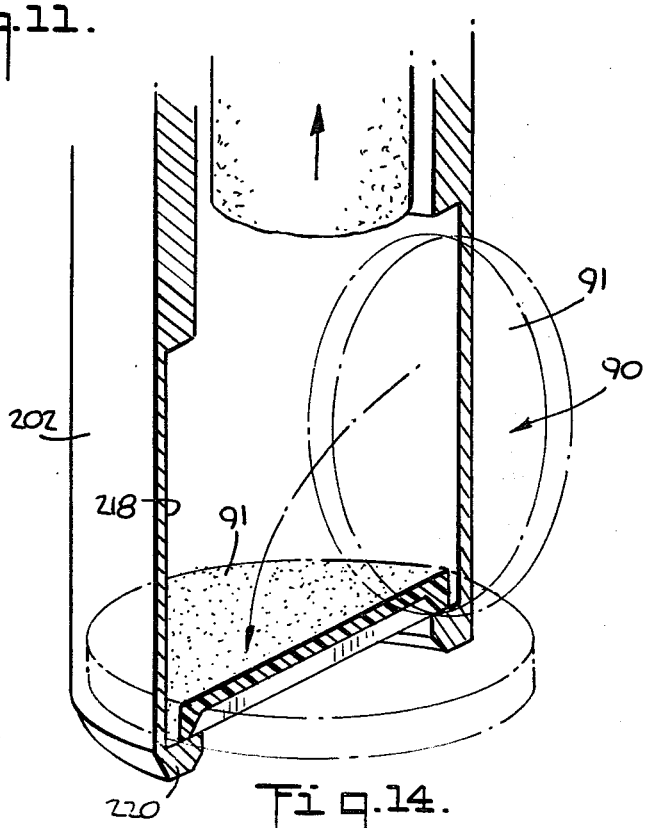
Fig. 14.

METHOD AND CORE BARREL APPARATUS FOR OBTAINING AND RETRIEVING SUBTERRANEAN FORMATION SAMPLES

BACKGROUND OF THE INVENTION

1. Field of the Invention

The invention relates to core barrel apparatus and methods for obtaining and retrieving sealed samples of subterranean formations and, more particularly, to expansion chambers, sample-receiving chambers and flap-valves thereof.

2. Description of the Prior Art

In the art of obtaining samples of subterranean formations it is well known to lower a coring device or other formation sampling apparatus into a well bore while suspended by a cable, a wire line, or a drill string. It is desired that not only the solid core sample but also any fluids present within the solid core sample be recovered and brought to the surface. Retaining fluids in the sampling apparatus, particularly the compressible gaseous fluids, is difficult and unreliable due to the extreme pressure differential between the sealed interior of the apparatus, in which is present the greatly elevated formation pressure at the bottom of the bore hole, and the relative low ambient atmospheric pressure when the sampling apparatus is brought to the surface. This pressure differential varies as a function of the depth of the bore hole; however it is not uncommonly in the range of 10,000 pounds per square inch.

Some known core barrel devices and sampling methods seal the sample at the formation pressure in a fluid-tight chamber which is capable of withstanding a high internal pressure while maintaining a fluid-tight seal as the sample is brought to the surface. Such fluid-tight chambers are provided with extremely strong and reliable seals, walls, etc. and yet are still prone to leak. Use of such chambers presents a safety hazard in that the high pressure within the chamber makes the sampling device difficult and perhaps even dangerous to handle, particularly when moving the chamber or attempting to withdraw the fluid and solid samples from the chamber.

It has been disclosed in U.S. Pat. No. 2,287,909, issued on June 30, 1942 to B. W. Sewell, that the pressure differential may be reduced by providing an expandable volume within the sampling apparatus into which volume the gases may expand to reduce the pressure differential. The sampling apparatus of the Sewell patent may not be adaptable for conditions encountered in comparatively deep bore holes due to the size of the expansion chamber shown in the Sewell U.S. Pat. No. 2,287,909. By way of example, the bottom hole conditions in a bore hole of approximately 10,000 feet in depth could be 10,000 psig and 200° F. Gas or vapor under such bottom hole conditions is of a density that will cause it to expand approximately four hundred times in volume when elevated to surface conditions. Further by way of example, if the core sample to be taken is approximately 4 inches in diameter and 20 feet in length and if the rock sample is 20% porous with half of the porous region occupied by gas, the gas would expand to approximately 70 cubic feet when elevated to surface conditions. Accordingly, a sampling apparatus for a deep bore hole must be provided with an expansion chamber capable of expanding to an appreciable volume. Furthermore, the apparatus disclosed in the Sewell U.S. Pat. No. 2,287,909 does not provide a selectively closed expansion chamber which may be sealed from drilling fluid and other substances as the device is lowered into the well bore and as a sample is taken. Thus, the chamber of the Sewell U.S. Pat. No. 2,287,909 may become filled with drilling fluid or other unwanted substances as the core sample is being obtained. Receiving drilling fluid or other substances in the expansion chamber of the device of the Sewell U.S. Pat. No. 2,287,909 not only can detract from the usefulness of the formation sample but also volume in the chamber is occupied which could otherwise provide additional volume for gaseous components of the sample as they expand.

It is apparently unknown in the prior art to maintain a sample chamber sealed or closed until opened at the bottom of a bore hole and to expand the sample chamber in response to the gases therein as the sample is brought to the surface.

With respect to seals for sampling devices, use of a rigid flap-type valve is known; however, such a valve which is intended to withstand high internal pressure while maintaining a fluid-tight seal requires a complex arrangement for storing the flap member while the sample is entering the chamber past the valve, and for closing the flap member thereafter and maintaining the fluid-tight seal. U.S. Pat. No. 797,622 which issued on Aug. 22, 1905 to W. S. Smith, and U.S. Pat. No. 2,347,726 which issued on May 2, 1944 to D. W. Auld et al. disclose a rigid flap member which is stored along the inner periphery of a core chamber. Other known flap members being of a rigid construction in the form of a flat disc or trap-door cannot conform to the circular interior of the sample chamber in which they are stored. Therefore the valve openings and the flap member must be made sufficiently small to permit storage of the flap member in the interior of the chamber.

As disclosed, for example, in U.S. Pat. No. 3,690,389 issued on Sept. 12, 1972 to Van De Beld et al., slip joint couplings are known for connecting parts of core barrels. As disclosed, for example, in U.S. Pat. No. 3,075,585 issued to L. A. Carlton on Jan. 29, 1963, the use of sealed and/or pressurized chambers are also known.

The present invention overcomes the aforementioned drawbacks and disadvantages of the prior art and provides additional advantages as well.

SUMMARY OF THE INVENTION

Apparatus for obtaining and retrieving a sealed sample from a subterranean formation according to the invention includes an inner core barrel which comprises an expansion chamber for sample fluids and a sample chamber for receiving the core sample obtained from the formation. Sealing means are provided for sealing the expansion chamber from the sample chamber while the apparatus is lowered in a bore hole and while the sample is being obtained and received in the sample chamber. The sample chamber includes a flap-valve which is closed to seal the lower end portion of the sample chamber after the sample is received therein. The flap-valve comprises a flexible flap member which is stored in the open position, the valve being deflected into a partially cylindrical shape. After the core sample is received in the sample chamber, the flap-valve is caused to move from its stored position, to assume a disc-like form to close the sample chamber. A sealing means between the sample chamber and expansion chambers is opened and fluids are permitted to pass into the expansion chamber. The sample is thus sealed at formation pressure in the sample chamber at one end by the flap-valve and by the expansion chamber at the other end.

During ascent of the sealed inner core barrel to the surface, the pressure within the bore hole applied to the exterior of the sealed inner core barrel decreases. As the bore hole pressure decreases during ascent, the fluids within the expansion chamber which were initially at the high formation pressure commence to expand. The expansion chamber is operative to expand initially in a lateral sense and subsequently in length as the pressure on the exterior of the expansion chamber decreases. The expanding of the expansion chamber provides an increasing volume therein into which the fluids can expand. The differential pressure from the interior to the exterior of the expansion chamber can thereby be maintained at a substantially low level with the result that the interior of the expansion chamber can approach surface atmospheric pressure or be at a reasonably elevated pressure as the expansion chamber approaches the surface.

In a preferred embodiment, the expansion chamber comprises a flexible tube which is preferably expandable both radially and axially with respect to the bore hole and which forms, in part, the sealed portion of the expansion chamber. A nominal pressure differential across the wall of the flexible tube, e.g. ¼ psig pressure within the tube greater than without the tube, is sufficient to expand the flexible tube from a flaccid condition to a taut condition. Thereafter, the flexible tube can expand both radially and axially to an extent at which the expanded tube occupies a portion or even all of the cavity in which it is disposed. Once further expansion of the tube is prevented by the cavity or the internal hoop strength of the tube, the pressure differential across the wall of the tube can increase causing the tube to stretch in length. In addition the apparatus comprises an outer core barrel assembly which is adapted to be connected to a drill string and in which the inner core barrel is located. The outer core barrel assembly includes an upper and lower core barrel interconnected by means for relatively locating the upper and lower core barrels as well as the expansion and sample chambers in a plurality of positions. The locating means provides for limited relative axial and rotational movement between the upper and lower core barrels, limited relative axial movement and rotational movement between the sample chamber and lower core barrel, and relative axial movement between the expansion chamber and sample chamber. Thus, the locating means provides a first relative position for lowering the apparatus into a well bore hole, and a second relative position for obtaining and receiving a sample in the sample chamber. The locating means further provides third transistory relative positions for securing and sealing the sample in the sample chamber, fourth transistory relative positions for connecting the expansion and sample chambers, and a fifth relative position for raising the apparatus to the surface. In the first position, the expansion chamber is sealed and axial clearance is provided proximate a core bit beyond the inner and on the outer barrels while the core barrel is being lowered into the bore hole. In the second position, the axial clearance is narrowed and the expansion chamber remains sealed while a core sample is cut. In the third positions, the core sample is enclosed and the sample chamber is sealed. In the fourth positions, the sample and expansion chambers are connected. In the fifth position which is similar to the fourth position, the clearance between the inner and outer core barrels is increased. In a preferred embodiment, the locating means comprises slip-joint means including pin means and slot means disposed in the outer core barrel.

These and other aspects of the present invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references apply to like parts and in which:

FIG. 6 is a horizontal section view taken along line 6—6 of FIG. 2 and showing the slip-joint;

FIG. 7 is an enlarged vertical section view showing the bearing assembly for securing the transfer tube and sample chamber to the upper outer core barrel and also showing the seal for the expansion chamber which is adapted to be pierced by a dart in the transfer tube after the sample is taken and after the sample chamber is sealed by the flap-valve;

FIG. 8 is a horizontal section taken along line 8—8 of FIG. 2 and showing the bearing assembly;

FIG. 13 is a horizontal section taken along line 13—13 of FIG. 2 and showing the flap-valve and a core catcher within the sample chamber for retaining a core therein;

FIG. 14 is a perspective view partially in section of the sample chamber portion of the core barrel and showing the flap-valve being closed;

FIG. 15 is a plan view of the lower face of the flap member of the flap-valve showing the juxtaposed load bearing elements in the planar configuration of the member;

DESCRIPTION OF THE PREFERRED EMBODIMENT

As is conventional in the art, a well bore hole is formed by means of a drill bit mounted on the end of a drill string and driven by drilling apparatus located on the surface. When the bore hole has been drilled to a depth at which it is desired to take a sample of the formation, the drill string is removed from the bore hole. A coring device is then attached to the lower end of the drill string in place of the drill bit. The drill string is then lowered into the bore hole. Rotation of the drill string causes the coring device to cut a core sample from the formation at the bottom of the bore hole. The drill string and coring device with a core sample retained therein are finally removed from the bore hole and the coring device is separated from the drill string at the surface.

Figures 1, 3, 4, 5:
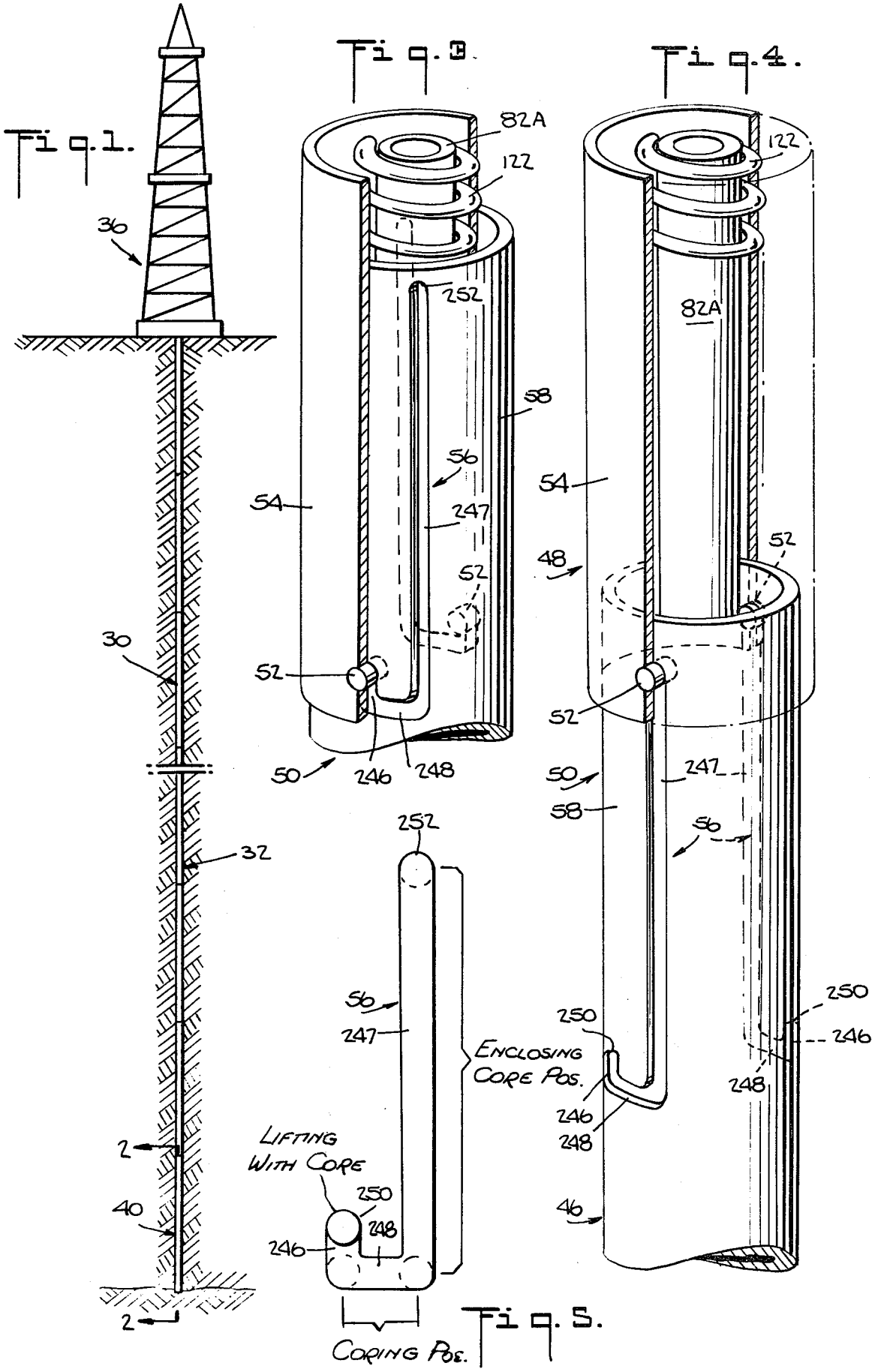
FIG. 1 is a schematic diagram showing the core barrel apparatus of the invention attached to a drill string in a well bore hole.
FIG. 3 is a fragmentary perspective view partially in section showing the slip-joint of the invention connecting the upper and lower outer core barrels positioned as they are shown in FIG. 2.
FIG. 4 is a perspective view partially in section showing the slip-joint in another position corresponding to the seating of the flap-valve member to close the sample chamber.
FIG. 5 is a schematic diagram showing the J-slot of the slip-joint and illustrating the position of the pins of the slip-joint corresponding to different operations of the core barrel apparatus.
Figure 2:
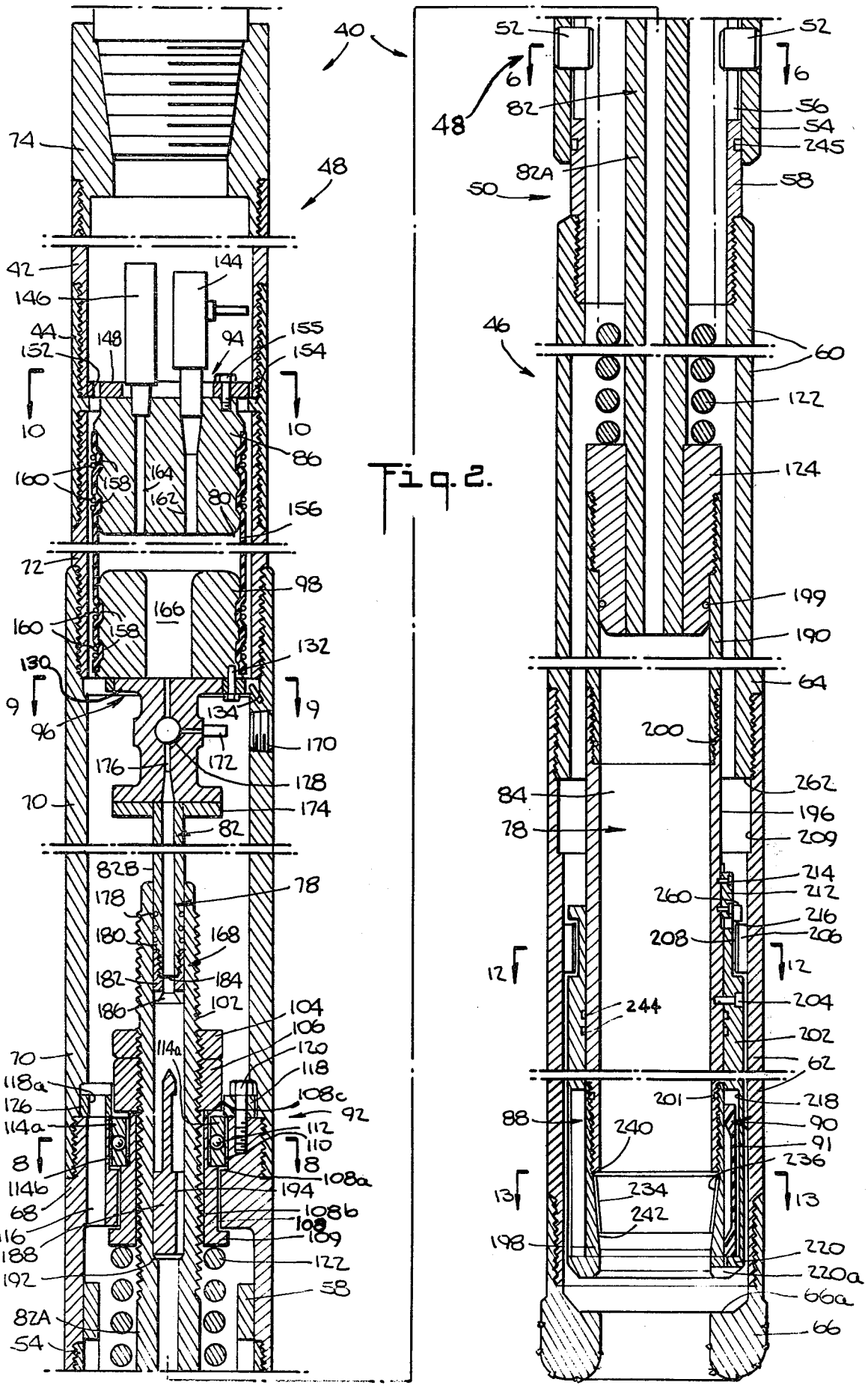
FIG. 2 is a vertical section view in two portions of the core barrel apparatus of FIG. 1 taken along line 2—2 thereof and showing the inner core barrel, the upper and lower outer core barrels, the expansion chamber, the sample chamber, the transfer tube and its seal, and the flap-valve of the invention in the position in which the core barrel apparatus is lowered into the well bore.

In accordance with a preferred embodiment of the present invention, the coring device is a core barrel assembly which is attached to a drill string. Referring to FIG. 1, the well bore hole is referenced by 30, the drill string by 32 and the surface apparatus by 36. Referring to FIG. 2, the core barrel assembly according to a preferred embodiment of the invention is referenced generally by 40. Core barrel assembly 40 comprises an inner core barrel and an outer core barrel between which drilling fluid or mud is forced in a downward direction. Thus, drilling mud is passed downwardly through the interior of the drill string and to the core barrel assembly when a core is being cut. The drilling fluid or mud flows back to the surface between the wall of the bore hole and the exterior of the drill string and core barrel.

Core barrel assembly 40 is secured to a section (not shown) of drill string 32 by a threaded sub or drill collar (not shown) (FIG. 2). The outer core barrel comprises a lower outer barrel section 46 and an upper outer barrel section 48 connected to one another by a bayonet-type slip-joint coupling 50. More particularly, this coupling, as shown more clearly in FIGS. 3–6, includes pins 52 which are secured in lower transfer tube housing 54 of upper barrel 48 and which are movable in J-slots 56 disposed in inner J-slot coupling member 58. Slip-joint coupling 50 provides for limited relative axial and rotational movement between the upper outer barrel section 48 and the lower outer barrel section 46 as well as the inner core barrel and parts thereof while permitting torque to be transmitted between the upper and lower outer barrel sections.

The upper and lower outer barrel sections, 48 and 46 respectively, comprising the outer core barrel are made up of individual sections and couplings as follows (FIG. 2). The lower core barrel section 46 comprises: lower transfer tube housing 60 threadedly secured to inner slip-joint coupling member 58; core bit sub 62; core bit sub coupling 64 threadedly securing housing 60 and sub 62; and core bit 66 threadedly secured to sub 62. The upper core barrel section 48 comprises: upper transfer tube housing 54 secured to inner slip-joint coupling member 58 by pins 52 for limited, relative axial and radial movement therewith; bearing housing 68 threadedly secured to housing 54; lower valve housing 70 threadedly secured to housing 68; expansion chamber housing 72 threadedly secured to housing 70; upper valve housing 42; and an outer barrel coupling 44 securing housing 72 to housing 42. The outer core barrel terminates in head 74 which is secured to the upper valve housing 42 by outer barrel coupling 44. Drill string sections (not shown) are connected to head 74 and each other to form the drill string. While it is understood that a plurality of sections and couplings may comprise sub 62 and housings 60, 70 and 72, only one section for each has been shown for clarity.

Elements 66, 62, 64, 60, 58, 54, 68, 70, 72, 44, 42 and 74 form the outer core barrel which extends from the lower end of the drill string 32 to the core bit 66. Disposed within the interior of the core barrel assembly 40 is an inner core barrel referenced generally by 78 (FIG. 2). The inner core barrel comprises three main parts which include, the expansion chamber 80, transfer tube 82 and sample chamber 84. The inner core barrel which extends from the expansion chamber upper terminal 86 to the core catcher sub, referenced generally by 88, is adapted to secure a core sample within sample chamber 84. A flap-valve 90 is provided for sealing the lower end of the inner core barrel.

Clearance is provided between the inner and outer core barrels for the circulation of drilling fluid therebetween. The drilling fluid is delivered downwardly through the interior of the drill string. The drilling fluid flows between the inner and outer core barrels adjacent the core bit 66. Thus, when the outer core barrel is rotated to cut a core sample, drilling fluid is circulated through the drill string between the inner and outer barrels and supplied to core bit 66 to lubricate and cool the bit. Thereafter, the drilling fluid passes back up the bore hole about the exterior of the outer core barrel and drill string. Core bit 66 may be a diamond core bit.

The inner core barrel 78 is supported and guided within the outer core barrel for relative rotational movement therebetween by bearing assembly 92. Transfer tube 82 includes a lower portion 82A and an upper portion 82B. As shown in FIGS. 2, 7 and 8, transfer tube lower portion 82A (to which is connected sample chamber 84) is secured to the outer core barrel (bearing housing 68) for relative rotation therebetween by bearing assembly 92. Thus, when the drill string and outer core barrel are rotated to cut a core sample, lower transfer tube 82A and sample chamber 84 of inner core barrel 78 remain stationary (FIG. 2).

Lower transfer tube 82A terminates at its upper end in a threaded section 102. Lower transfer tube 82A is supported with respect to housing 68 by bearing 112. Upper spring seat 108 includes an axial bore 108*b* adapted to fit about the exterior circumference of threaded section 102 for slidable movement therealong. In annular recess 110 within housing 68 is disposed ball bearing 112 having upper and lower bearing races 114*a* and 114*b*, respectively. Axial bores 116 are provided in housing 68 to permit passage therethrough of drilling fluid between the inner and outer barrels as mentioned hereinbefore. Bearing retainer 118 mounted on housing 68 by screws 120 engages upper bearing race 114*a* and secures the bearing 112 against upward movement by urging the lower bearing race 114*b* against annular seat 108*a* of spring seat 108. Bearing retainer 118 contains openings 118*a* which align with bores 116 in bearing housing 68, thereby providing passages for the drilling fluid. The bearing assembly 112 has its upper race 114*a* biased against retainer 118 by the upward force of spring 122 applied to spring seat 108 and thereby to lower race 114*b*. Transfer tube 82A is biased downwardly by spring 122 and is maintained in position by the piloting action of the bore 108*b* of spring seat 108. The adjustment nut 106 attached to the threaded section 102 bears upon the upper end 108*c* of spring seat 108 in response to the downward force applied to transfer tube 82A by spring 122. The downward force is applied by the lower end of spring 122 to lower spring seat 124 which will be described more fully hereinafter. An annular recess 126 coextensive in part with openings 118a is provided in lower valve housing 70 for the passage of drilling fluid or mud.

Referring now to FIGS. 9 and 10 and again to FIG. 2, expansion chamber 80 and upper transfer tube 82B of the inner core barrel are supported and guided within the outer core barrel by guide assemblies 94, 96. The lower guide assembly 96 supports upper transfer tube 82B and expansion chamber terminal 98 within the outer barrel. Expansion chamber tie-plate 130 is secured to expansion chamber terminal 98 by mounting bolts 132. In turn the tie plate is secured to the lower valve housing by Rollpin-type fasteners 134 disposed in slots 136 and 138 of the tie-plate and lower valve housing. The Rollpin-type fasteners are longitudinally split, hollow cylindrical pins made of a spring metal material, frictionally engaged within mounting holes in housing 70. Tie-plate 130 has a central opening 140 therein through which lower valve 128 is connected to terminal 98 by bolts 142. Thus, assembly 96 secures terminal 98, lower valve 128 and upper transfer tube 82B to the outer barrel to rotate with the outer barrel.

Figure 9:
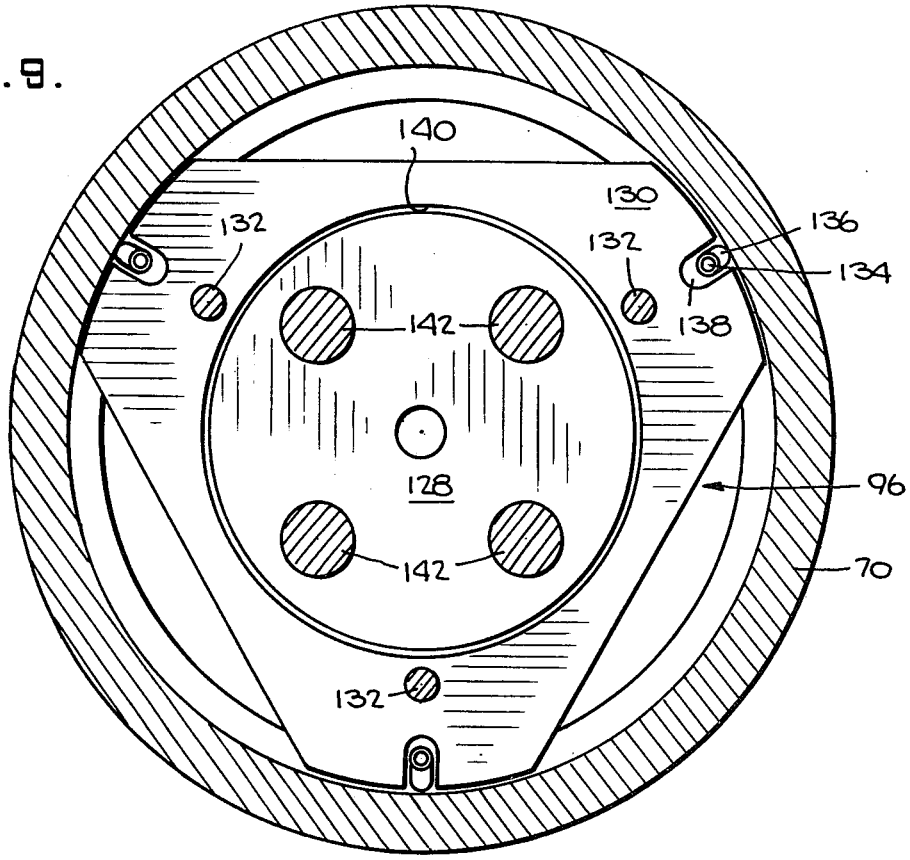
FIG. 9 is a horizontal section taken along line 9—9 of FIG. 2 and showing the lower terminal and lower guide assembly of the expansion chamber.
Figure 10:
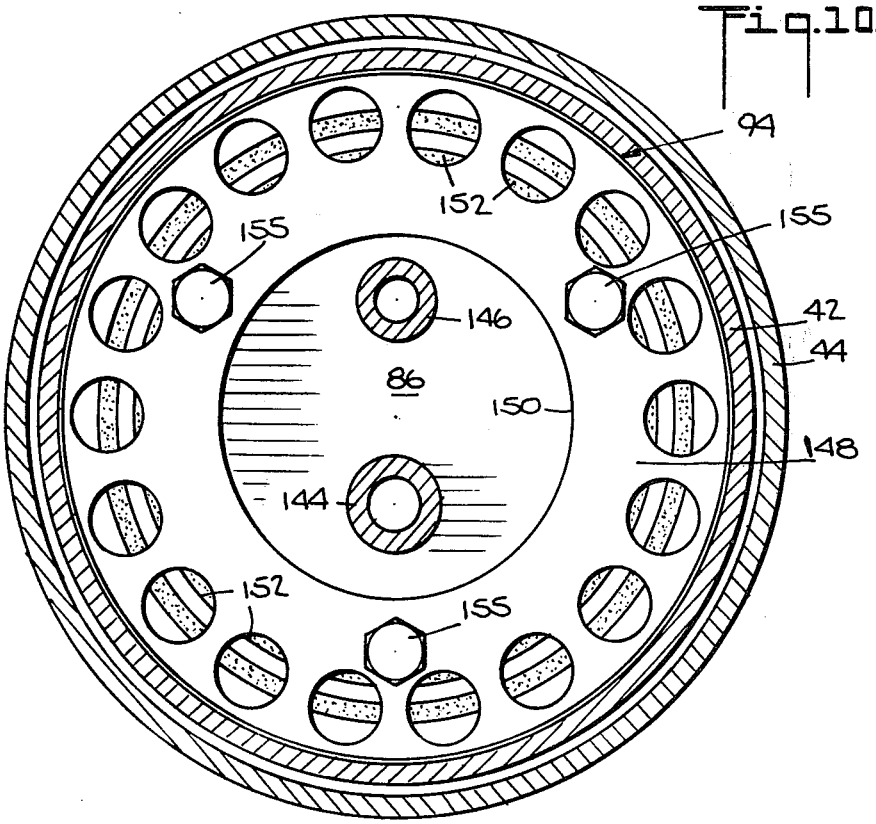
FIG. 10 is a horizontal section taken along line 10—10 of FIG. 2 and showing the upper terminal and upper guide assembly of the expansion chamber.

The upper transfer tube 82B is telescoped into threaded section 102 of the lower transfer tube 82A for relative rotational and axial movement as will be described more fully hereinafter. Tie-plate 130 is of triangular form and therefore its peripheral edges form clearances with the cylindrical interior surface of the outer core barrel (FIG. 9). The clearances between the edges of the tie-plate and the inner surface of the outer core barrel permit passage of drilling fluid therebetween.

Valve guide assembly 94 (FIGS. 10 and 11) supports and guides upper expansion chamber terminal 86, upper expansion chamber needle valve 144 and expansion chamber pressure relief valve 146 for axial movement thereof along and within the upper valve housing 42. Guide assembly 94 includes expansion chamber upper tie-plate 148 which is circular in form and has a central opening 150 and a plurality of openings 152 arranged radially above the tie-plate. Plate 148 is generally coextensive with the inner surface of the outer core barrel; however, openings 152 permit passage of drilling fluid therethrough. Outer barrel coupling 44 includes an annular rib 154 which extends beyond the inner surface of the upper valve housing 42 to form a stop or shoulder on which tie-plate 148 rests, thereby preventing downward movement of the tie-plate in the outer core barrel. This arrangement enables guide assembly 94 and upper terminal 86 in upper valve housing 42 to rotate therewith while permitting axial movement of the guide assembly and terminal in the upper valve housing. Bolts 155 secure the tie-plate to upper terminal 86 to support the terminal. Needle valve 144 and relief valve 146 are mounted in the terminal.

Referring now to FIG. 11 and again to FIG. 2, expansion chamber 80, a portion of the inner core barrel, comprises upper and lower terminals 86, 98 and expandable or elastic membrane member 156. Member 156 at opposed ends thereof is secured about the terminals by means of annular grooves 158 and wire bands 160 seated therein over the membrane. Thus, a fluid-tight chamber is formed. The chamber has openings 162 and 164 closed by valves in the upper terminal and the opening 166 formed in the lower terminal. Needle valve 144 and relief valve 146 are normally closed. Opening 166 is connected to transfer tube 82B which is closed by sealing disc 184 (FIGS. 2 and 7) which will be described more fully hereinafter. Membrane 156 is of elastic material which can be extended or stretched in the circumferential and/or axial directions. The membrane can comprise a reinforced tubular member formed, for example, of a layer of chemical-resistant rubber material reinforced with resin material, such as nylon. The elastic material can also comprise a chamber formed from thin sheet metal material. The expansion chamber expands in response to any pressure within the interior of the chamber which is at all greater than the pressure at the exterior thereof. Such a pressure difference can cause both circumferential and axial stretching of the membrane. Axial expansion or stretching of the membrane causes movement of upper terminal 86 in an upward direction in the upper valve housing. During such movement, upper terminal 86 is guided by assembly 94. Lower terminal 98 remains stationary.

Needle valve 144 enables fluids, particularly gases, to be removed from chamber 80 into a suitable tank or receptacle. Relief valve 146 vents the interior of chamber 80 if the pressure differential between the interior and exterior of the chamber exceeds a predetermined value. Lower valve 128 which can be a ball valve disposed in passage 176 is also provided to permit removal of fluids, particularly liquids, from chamber 80. A removable plug 170 provided in lower valve housing 70 permits access to actuator 172 of valve 128 from the exterior of the housing. Expansion chamber 80, including valves, terminals and guide assemblies, and upper transfer tube 82B rotate with the outer core barrel and drill string.

Connecting expansion chamber 80 to sample chamber 84 is transfer tube 82 comprised of upper transfer tube 82B and lower transfer tube 82A (FIG. 2). Upper transfer tube 82B is connected to lower valve 128 by means of plate 174 to provide fluid-tight communication between passage 176 of the valve and the interior of the upper transfer tube. The lower end of the upper transfer tube 82B is disposed in the interior of the upper end of the lower transfer tube 82A for axial and rotational movement therein. A plurality of O-ring seals 178 (FIG. 7) enable the axial and rotational movement to take place without leakage. The lower end of upper transfer tube 82B terminates in externally threaded section 180 and a threaded sleeve or disc retainer 182. A sealing disc 184 is disposed on a shoulder on disc retainer 182, the disc being clamped at the shoulder by sleeve 180 to form a fluid-tight seal. A tool socket or slot 186 is provided at the lower end of disc retainer 182 to enable section 182 to be driven onto section 180. Lower transfer tube 82A is retained at one end thereof in bearing housing 68 and the other end terminates in lower spring seat 124 (FIG. 2). Spring seat 124 is threadedly secured in upper portion of barrel 190 of the sample chamber.

As shown in FIG. 8, the base portion of dart 188 has an axial slot 194 therein for the passage of fluids therethrough. The tip of dart 188 is spear-shaped to permit passage of fluid from the lower transfer tube 82A to the upper transfer tube 82B after the dart has ruptured sealing disc 184 (FIG. 7), the fluid passing through axial slot 194, through the space between the dart and the ruptured seal, and past the spear-shaped tip of the dart.

Lower transfer tube 82A is axially movable with respect to bearing housing 68 and the outer barrel since it is slidable within spring seat 108. Nut 106 attached to the threaded upper end 102 of transfer tube 82A controls the position of the lower transfer tube by engaging end 108C of spring seat 108. Adjustment nut 106 enables the position of the lower transfer tube with respect to the outer core barrel to be selectively set. Jam nut 104 secures nut 106 in its adjusted position on threaded section 102.

Upper transfer tube 82B is fixed to the outer barrel as described hereinbefore. The relative axial movement between the upper and lower transfer tubes causes dart 188 to strike and pass through sealing disc 184, thereby enabling vapor and gas to enter the expansion chamber 80.

Figure 12:
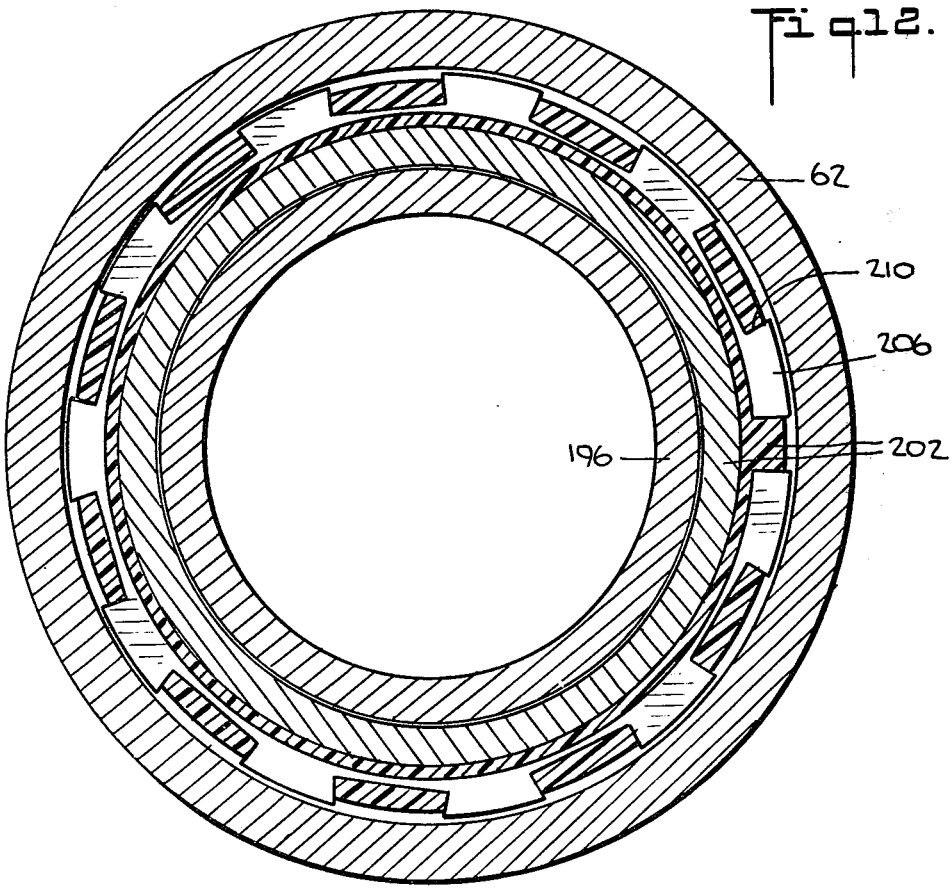
FIG. 12 is a horizontal section view taken along line 12—12 of FIG. 2 and showing a latch ring for restricting upward movement of the flap-valve housing while a core sample is being enclosed in the sample chamber and the flap-valve thereafter closed.

As shown in FIG. 2, the sample chamber 84 comprises upper barrel 190, sample chamber sub 196 and core catcher sub 198. Barrel 190 is threaded at one end to spring seat 124 and at the other end to sub 196 which in turn is threaded to sub 198. O-ring seals 199–201 are provided to seal the respective joints. Telescoped over subs 196 and 198 is flap-valve housing 202 which is secured to sub 196 by shear screw 204. Referring to FIGS. 2 and 12, latch ring 206 is carried in circumferential slot 208 in housing 202 and is axially moveable together with housing 202 in core bit sub 62. Ring 206 which is split and spring-tensioned radially outwardly is maintained in compression by core barrel sub 62. When ring 206 is moved into annular slot 209 of core barrel sub 62, ring 206 expands radially in an outward direction to engage the walls of the slot. Ring 206 has axial slots 210 radially disposed about is outer periphery to permit passage of drilling fluid. Key 212 is secured to the exterior of sample chamber sub 196 by bolts 214. An axial slot or keyway 216 is provided in flap-valve housing 202 to prevent relative rotation between housing 202 and sub 196, as will be more fully described hereinafter.

Figure 16:
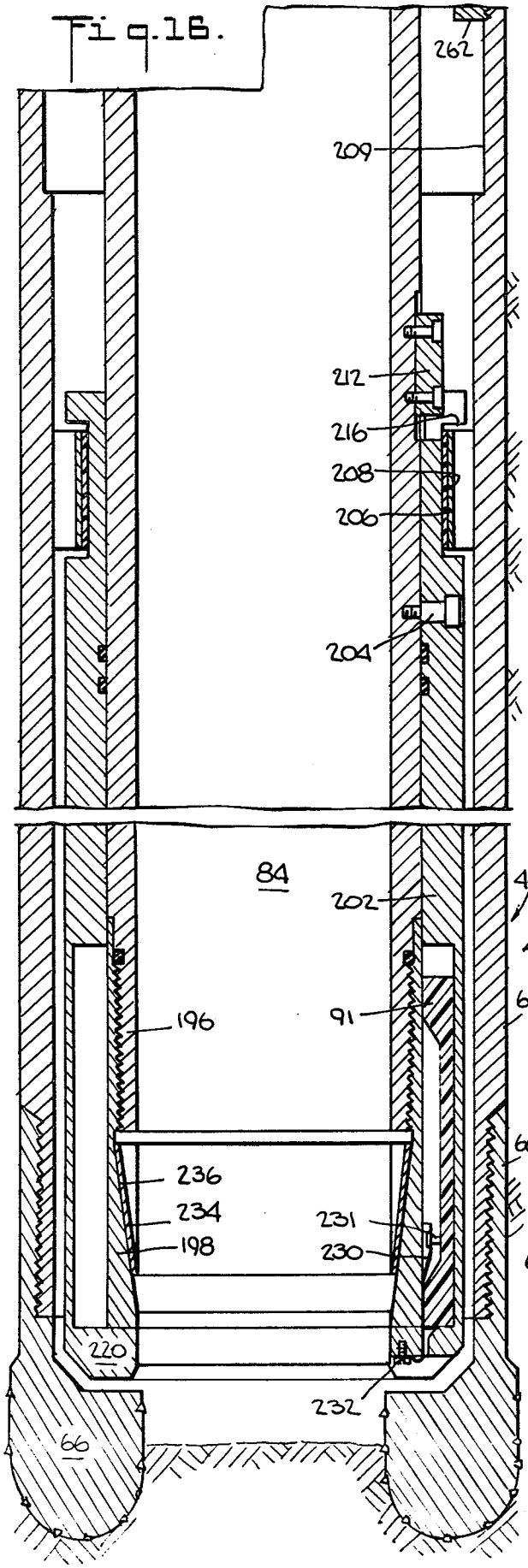
FIGS. 16 and 17 are enlarged vertical sections of the sample chamber portion of the core barrel showing a sample being cut and broken from a formation.
Figure 20:
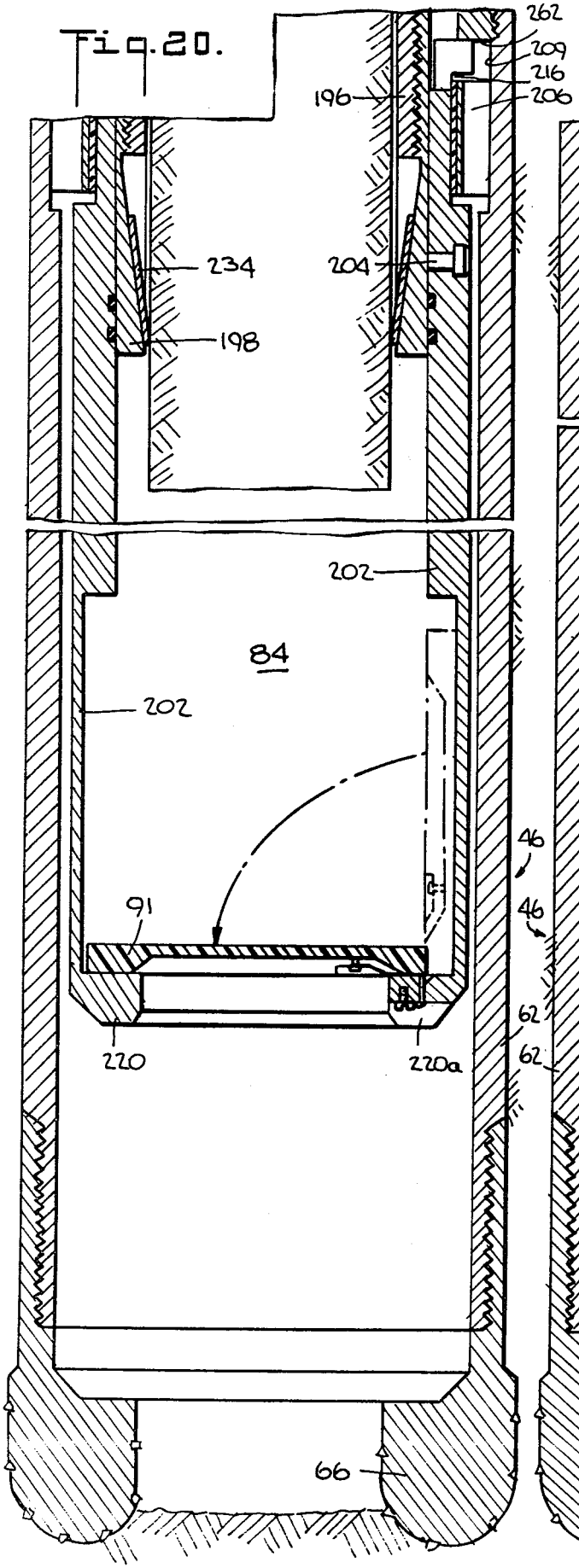
Figure 21:
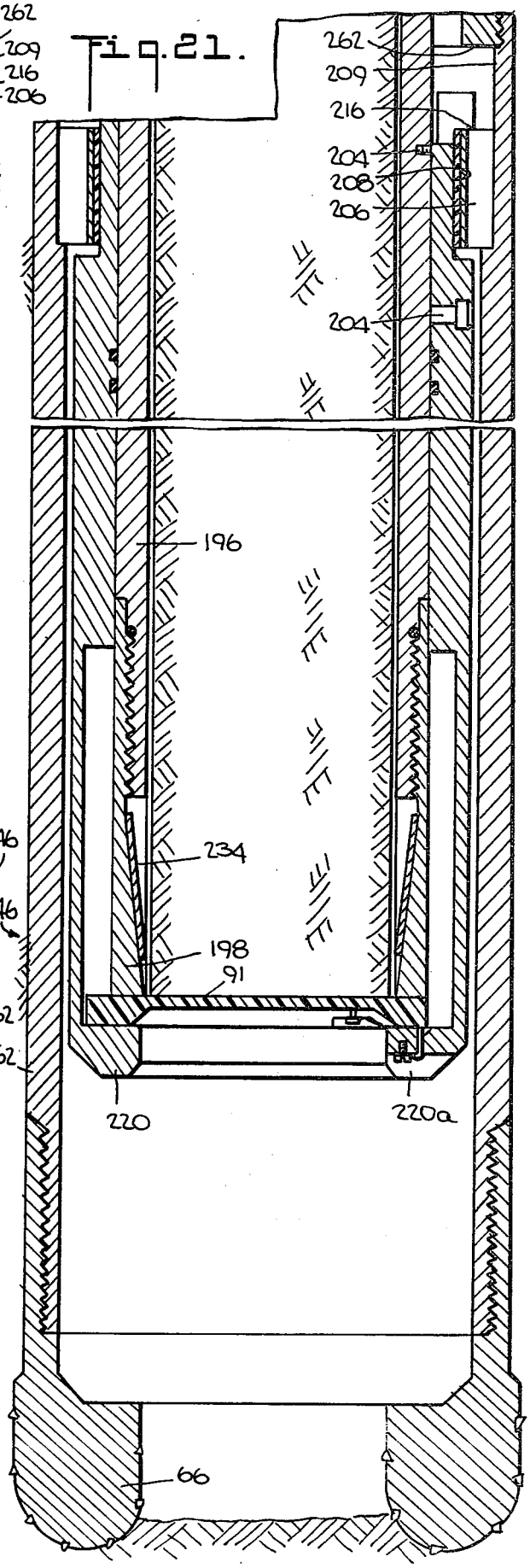
FIG. 21 is an enlarged vertical section of the sample chamber part of the core barrel showing the flap member being engaged to seal the sample chamber.

Disposed in annular slot 218 of flap-valve housing 202 and resting on shoulder 220 thereof is flap-valve 90. As shown in FIGS. 12–16, flap-valve 90 which includes flap member 91 is flexible in one plane. When stored in the open position of the valve in annular recess 218, the flap member 91 has a partially cylindrical, deflected shape conforming to the inner surface of slot 218 and the outer surface of the core catcher sub 198 (FIG. 16). When the valve is closed, flap member 91 is seated on shoulder 220 and is disc-like in shape with a planar horizontal cross section as shown in FIGS. 20 and 21.

Flap member 91 comprises a circular, resilient, fluid-sealing base 222 and a plurality of closely-spaced, narrow load bearing elements or bars 224 extending parallel to one another (FIG. 15). The base is preferably made of a resin material or natural or synthetic rubber but may also be made of other fluid-impermeable, resilient materials. In one embodiment, the base is made from a resin known as Compound V14 (Viton Fluorel). Bars 224 each include a rib 226 which has a trapezoidally-shaped transverse section (FIG. 13). The resilient base 222 is molded about the bars and engaged to the ribs of each. Bars 224 are juxtaposed and separated by a small space. Due to the resiliency of the base, the trapezoidal shape of ribs 226, and the spaces between the bars, the entire flap member 91 may be deflected or flexed about an axis or axes corresponding to the longitudinal axis of one or more bars. The flap member 91 which is shown deflected in FIG. 13 to conform to the cylindrical shape of the annular recess 218 by the outer surface of sub 198. Thus, the flap member is held deflected against the resiliency of the base 222 which tends to urge the valve member into the planar configuration shown in FIG. 14. In FIG. 14 the valve member is shown resting on shoulder 220 of housing 202. Upon raising sub 198 (FIG. 20) above flap member 91, the flap member springs out into a planar configuration. A retainer or leash 230 which is preferably made of wire material (FIGS. 15, 18 and 19) is attached by screw 231 to the flap member and screw 232 to slot **220*a* in shoulder 220 to urge flap member 91 to swing downwardly into its closing position. Thus, the leash insures that the flap member closes in a hinge-like manner and properly seats upon shoulder 220**.

Mounted in core catcher sub 198 is core catcher 234 for engaging a core received in chamber 84 and preventing the core from falling therefrom (FIGS. 13 and 17–19). The core catcher can assist in the procedure of the breaking of the core from the bottom hole formation after a sufficient core has been obtained. As shown in FIG. 16, core catcher 234 is generally in the shape of a trucated cone, slidably mounted in mating annular groove 236 in sub 198. The core catcher has axial serrations or teeth 238 which are tapered in a radial direction with respect to longitudinal axis of the core catcher. Thus, the teeth taper from a maximum thickness at the top 240 of the catcher to a minimum thickness at the base 242 thereof. Core catcher 234 is split longitudinally with the result that its inside diameter decreases in accordance with downward movement in annular groove 236. As a result, core catcher 234 permits upward axial movement of a core but not downward movement. Thus, the catcher, whenever moved downwardly by a core, contracts in diameter, thereby resulting in serrations 238 grasping the core and preventing further downward movement thereof. This is shown more clearly in FIGS. 16–19.

O-ring seals 244 positioned between sample chamber sub 196 and flap-value housing 202 permit relative axial movement between the sub and housing while sealing the two against fluid flow therebetween. Thus, seals 244 prevent passage of drilling fluid between sub 196 and housing 202 up into chamber 84.

As mentioned hereinbefore, slip-joint coupling 50 provides for relative axial and radial movement between upper core barrel 48 and lower core barrel 46. An O-ring seal 245 is provided between coupling member 58 and housing 54. Referring to FIGS. 3–5, pins 52 are fixed and retained in lower transfer tube housing 54 by keeper springs 53, and J-slots 56 having short axial slot 246, long axial slot 247 and radial slot 248 are disposed in coupling member 58. Axial slots 246, 247 limit the axial movement of pins 52 therein and radial slot 248 limits the radial movement of the pins 52 therein. Drilling torque is transmitted through the drill string from the upper barrel pins 52 to coupling member 58 of the lower barrel by engagement of the pins against the axial walls of the slots. The upper barrel supports the lower barrel when pins 52 are in the uppermost ends 250 of axial slots 246 (FIG. 3) when the drill string is being lowered into or raised out of the well bore, and when pins 52 are in the uppermost ends 252 of axial slots 247 (FIG. 4) when the core is being broken and the sample chamber sealed, as will be described more fully hereinafter.

OPERATION

Figure 17:
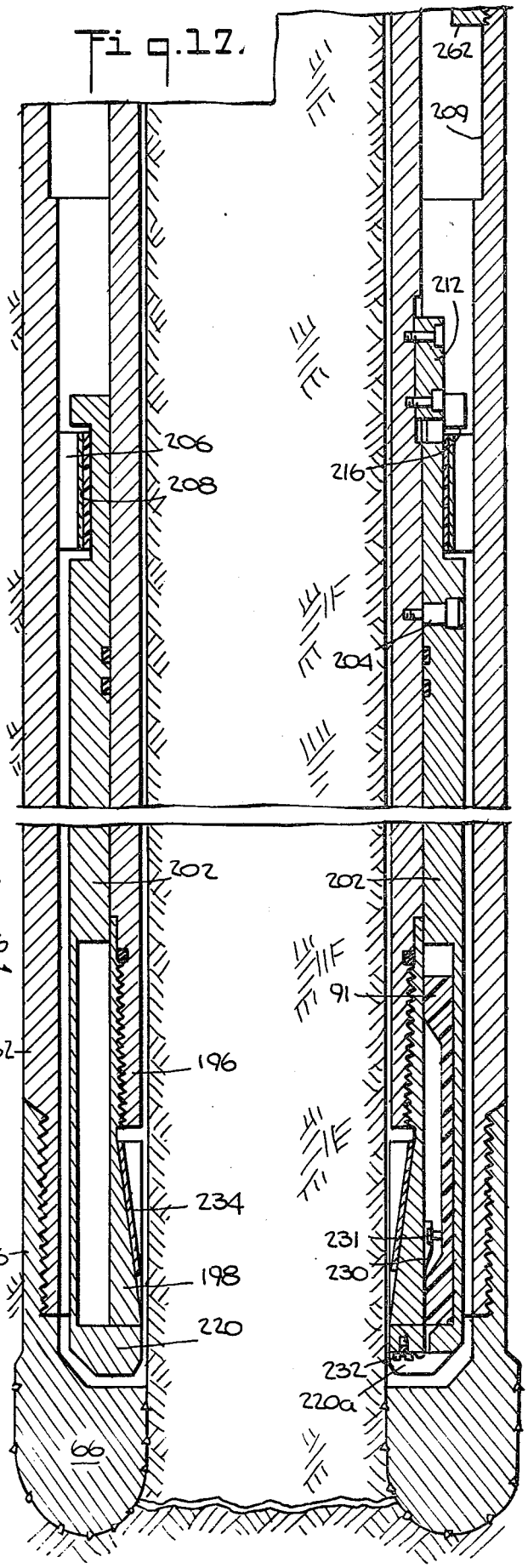

Core barrel 40 operates with drill string 32 to obtain a sample as follows. Core barrel 40 including core bit 66 forms the lower-most end of the drill string, the core barrel being attached to drill string sections and lowered into well bore 30. As core barrel 40 is being lowered into the well bore, the relative positions of the core barrel members are as follows. Referring to FIGS. 2, 3 and 5, the lower barrel section 46 (coupling member 58) is supported by the upper barrel section 48 (lower transfer tube housing 54) by pins 52 in upper-most ends 250 of short axial slots 246 of the J-slots 56 in coupling member 58. Thus, the sample chamber 84 is supported by pins 52 as the core barrel is being lowered into the bore hole. In this position, adjustment nut 106 is adjusted to move the lower transfer tube 82A in the bearing assembly 92 so that the distal end of the inner core barrel (shoulder 220 of flap-valve housing 202) assumes the position shown in FIG. 2. As shown in FIG. 2, the clearance between the lower face of shoulder 220 and the upper face **66*a* of core bit 66 is of an intermediate distance. Axial spring 122 is pre-tensioned by adjusting nut 106, thereby causing compression of the spring against shoulder 108*a* of spring seat 108. The spring seat is thereby urged against bearing 112. Nut 106 is adjusted to obtain the desired clearance of the lower face of shoulder 220 with respect to the upper face 66*a* of the core bit. The adjustment is made to cause the clearance to be a limited one as shown in FIGS. 16 and 17 when the apparatus is in the coring condition, i.e. when pins 52 are disposed in slots 248 shown in FIG. 5. By way of example, the clearance can be approximately one-eighth inch. Jam nut 104 locks nut 106** in its adjusted position.

Spring 122 assists in maintaining the lower transfer tube 82A and the sample chamber 84 in the position shown in FIG. 2. Shear screw 204 prevents relative axial movement between sample chamber sub 196 and flap-valve housing 202. Key 212 in keyway 216 prevents relative radial movement between the sub 196 and housing 202.

The drill string and core barrel are thus lowered in the well bore until the core bit 66 reaches the bottom of the well bore. At this point, the upper barrel 48 moves axially downwardly with respect to the lower barrel 46 in slip-joint 50. In particular, pin 52 travels down axial slot 246 until it strikes the bottom of the J-slot. This position is shown in FIG. 5 and is referenced as "coring position". The axial positioning of the short slot 246 of J-slot 56 limits the lowest axial position of the upper core barrel and inner core barrel relative to the lower core barrel. This limited axial relative position causes shoulder 220 to be separated from core bit 66 by the narrow clearance referred to above and shown in FIGS. 16 and 17. This clearance is sufficiently large to permit the passage of drilling fluid between shoulder 220 and the core bit 66 while at the same time inhibiting the flow of drilling fluid upwardly into the interior of sample chamber 84. Again this narrow clearance is predetermined by the axial positioning of short slot 246 and the setting of adjustment nut 106.

With the core bit in the configuration shown in FIG. 16, the drill string is rotated, thereby rotating the outer lower core barrel 46 and core bit 66 to cut a core sample from the formation. Shear screw 204 secures sample chamber sub 196 and flap-valve housing 202 against movement therebetween. Thus, there is no relative axial movement between the sample chamber sub and the flap-valve housing. Key 212 is positioned in short keyway 216 of the flap-valve housing to prevent radial movement or rotation between the flap-valve housing and the sample chamber sub.

As core bit 66 is rotated, the sample chamber 84 remains stationary and sample material progresses upwardly into the core chamber while the core barrel and drill string progress downwardly into the formation. This is shown in FIG. 17. When a sufficient amount of core has been taken into the sample chamber (for example, 20 feet of core), it becomes necessary to break the core from the formation. The amount of core sample taken is determined from the surface by observing the distance that the drill string moves downwardly into the formation while coring. During coring, the major portion of the weight of the drill string and core barrel apparatus is supported from the surface with the result that a controlled reduced force urges the core bit against the bottom of the bore hole.

During the time that the drill string and core barrel are lowered into the well bore and during the time that the sample is being cored, dart 188 assumes the position shown in FIG. 2 in which seal 184 is intact. Therefore, the expansion chamber 80 is completely sealed during lowering and during coring operations. Accordingly, no drilling fluid or other substances are permitted to enter the expansion chamber. In one embodiment, the expansion chamber membrane 156 is made of a rubberized, nylon-reinforced fabric. A suitable fabric is Dura-Tite five inch diameter fire hose. This expandable or stretchable fabric stretches radially and axially when subjected to an internal positive pressure. By way of example, the expansion chamber can be approximately sixty feet in length with the capability of stretching approximately ten percent in length. Further by way of example, the expansion chamber can be fitted with a housing having a diameter of approximately $6\frac{7}{8}$ inches. Where the bore hole is a "hot well" having, for example, a temperature of about 400° F., a fabric hose coated with "TEFLON" fluorocarbon material can be used. A thin sheet metal tube can also be used.

The expansion chamber, whether a coated fabric hose or thin metal tube can not withstand appreciable positive external pressure, tending to collapse the interior volume of the chamber to zero. Therefore, the expansion chamber 80 is exhausted of compressible fluids such as air at the surface and there partially filled with an incompressible fluid whose properties are known and which will not affect any sample fluids entering the expansion chamber. The quantity of the incompressible fluid is chosen to prevent the walls of the hose or tube from being totally flattened by external pressure at the bottom of the well bore. The incompressible fluid can be water. Another suitable fluid is oil. With uniform external pressure applied to the chamber, the fluid within the chamber, being incompressible, prevents the walls of the chamber from collapsing since a pressure corresponding to and in response to the external pressure is applied by the incompressible to the inner surface of the walls of the expansion chamber. Since the fluid is of known composition, it can be identified in the test sample contents of the expansion chamber and therefore does not confuse or disrupt the test sample.

Figure 11:
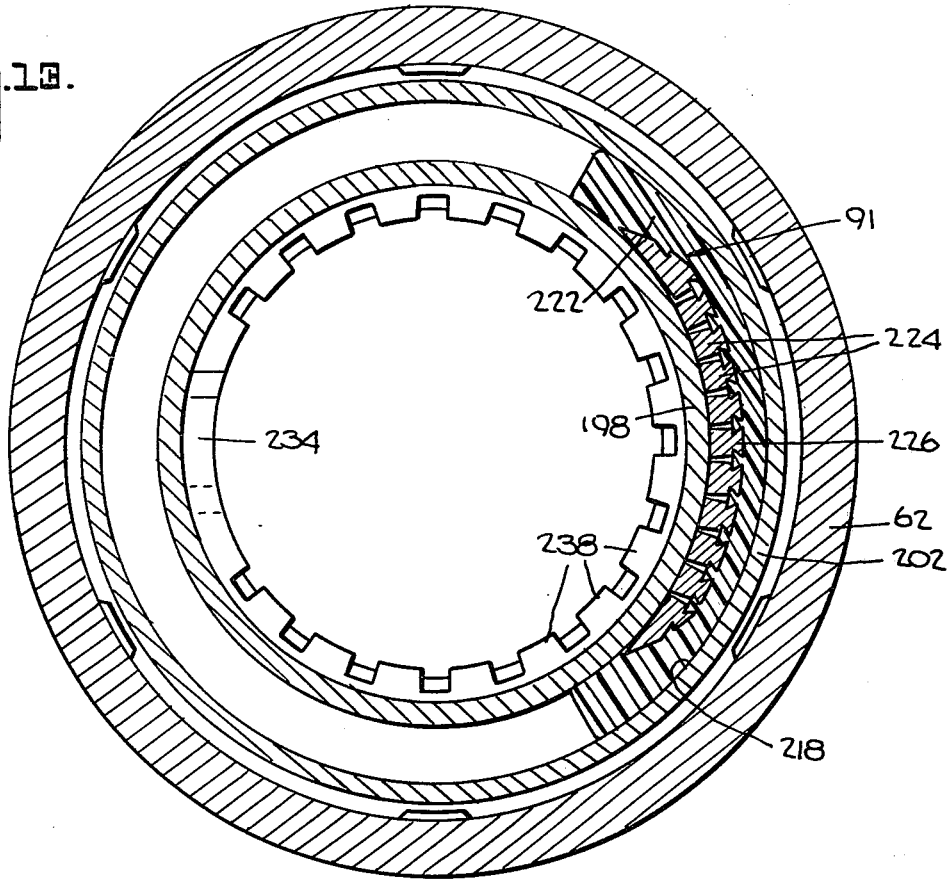
FIG. 11 is a vertical section of a portion of the core barrel apparatus containing the expansion chamber.

On the way down into the well bore hole, the expansion chamber is substantially collapsed as generally shown in FIG. 11. This is due to the external pressure of the drilling fluid or mud being applied to the exterior of the expansion chamber. This external pressure can increase at the rate of approximately one pound per square inch pressure per foot of depth. Thus, when the core barrel is lowered to a depth of about 10,000 feet, the external pressure will be about 10,000 pounds per square inch.

When the desired amount of core has been taken as determined by measurements at the surface, rotation of the drill string is stopped. The core then must be broken from the formation at the location of the entrance to the inner core barrel. There are several ways to accomplish this. One way is to cause surges in the pressure of the pump supplying the drilling fluid to provide a varying lifting force to the core barrel and drill string at the bottom of the well. Another way is to intermittently start and stop the rotation of the core barrel and drill string. This latter method is known as rocking.

As shown in FIG. 17, the core typically is broken from the formation adjacent the opening of the core bit. Referring to FIG. 18 and FIGS. 3–5, the drill string and upper core barrel are then rotated to a limited extent in a direction opposite to the direction of rotation used for coring with sufficient force on upper core barrel 48 to cause pins 52 to be disposed in slots 248 of the J-slots. Coring and drilling is usually accomplished by a clockwise rotation, looking down from above. Moving the drill string in a counter-clockwise direction causes pins 52 to move in slots 248 of the J-slots until the pins are positioned at the bottom of long axial slots 247. The drill string and thereby upper core barrel 48 are then lifted with the result that pins 52 travel upwardly in slots 247. This lifting moves the inner core barrel upwardly while the lower outer core barrel 46 remains stationary since upward movement of upper core barrel 48 is transferred to lower transfer tube 82A by bearing 112 and adjusting nut 106. Movement of the inner core barrel is shown best in FIGS. 17 and 18.

Figure 18:
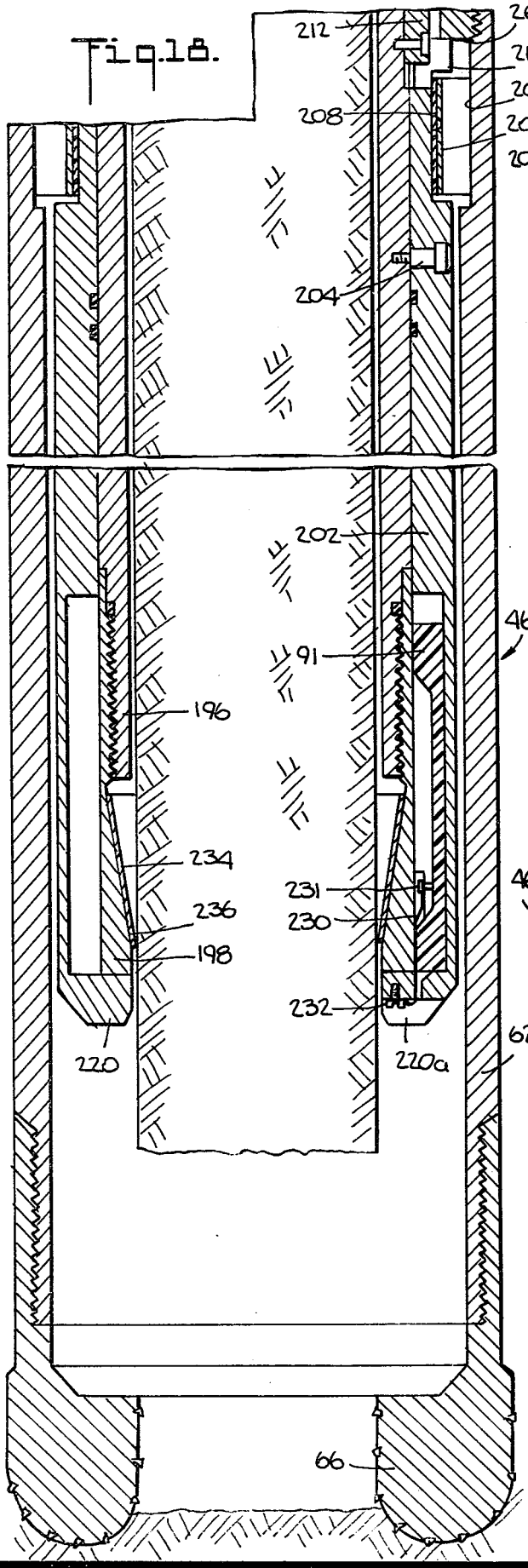
FIGS. 18–20 are enlarged vertical sections of the sample chamber portion of the core barrel showing the sample being enclosed in the sample chamber and the flap member being closed.

Flap-valve housing 202 moves upwardly with the inner core barrel since it is secured to sample chamber sub 196. Upward movement of flap-valve housing 202 carries resilient latch ring 206 with it in annular slot 208 of the flap-valve housing until the ring reaches annular slot 209 in core bit sub 62 of the lower barrel 46. When the latch ring reaches slot 209, it expands outwardly into the slot and is retained therein (FIG. 18). In this way sample chamber sub 196 becomes keyed by latch ring 206 to core bit sub 62 and is prevented from moving further in an upward direction. At this point, the upper end 260 of the flap-valve housing 202 abuts and engages the upper wall 262 of annular slot 209. This prevents further upward movement of the flap-valve housing with respect to core bit sub 62 of lower barrel 46.

Figure 19:
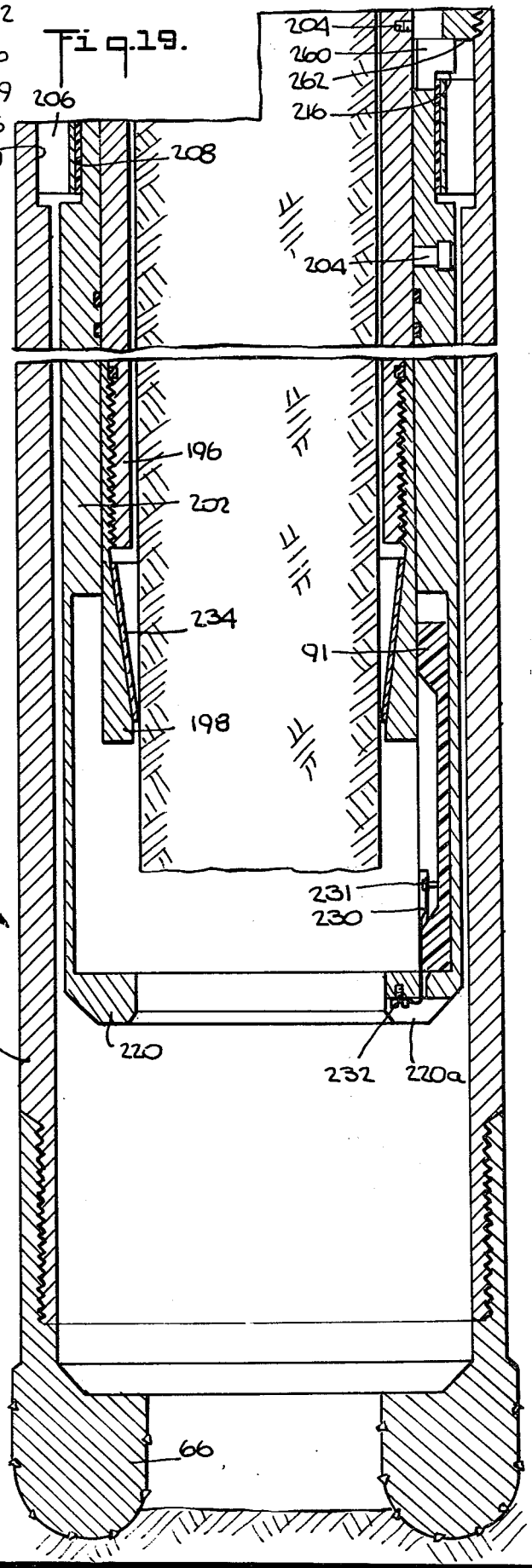

Continued upward movement of the upper core barrel 48 and pins 52 thereof in slots 247 carries sample chamber sub 196 upwardly. Since flap-valve housing 202 is prevented from moving upwardly any further, movement of the core chamber sub 196 in response to movement of upper core barrel 48 causes shear screw 204 to be sheared thereby permitting further upward movement of the core chamber sub 196 (FIG. 19). Shear screw 204 is designed to shear at a predetermined shear stress which is sufficiently large to secure housing 202 axially to sub 196 until upper end 260 of housing 202 abuts upper wall 262 and latching ring 206 is engaged in slot 209.

As the flap-valve housing 202 and sample chamber sub 196 of the inner core barrel are raised with the drill string, core catcher 234 retains the broken core in the sample chamber 84 (FIGS. 18 and 19). Movement of the split core catcher in conical seat 236 changes the diameter of the core catcher as described hereinbefore. Thus, when the core is being lifted, it urges the core catcher to move axially downwardly. This causes a wedging action of the core catcher in conical seat 236 which results in a decrease in the inside diameter of the core catcher. The reduced diameter of the core catcher and the frictional engagement of the core with the axial teeth 238 retain the core in the sample chamber.

FIG. 18 shows the core barrel in the configuration at which screw 204 is about to be sheared while key 212 is still engaged with keyway 216. FIG. 19 shows the configuration of the core barrel after screw 204 has been sheared and sub 196 raised further with key 212 in upper portion of keyway 216. In the position of the sample chamber sub 196 shown in FIG. 19, pins 52 have not yet reached the uppermost ends 252 of J-slots 247. Accordingly there can be still further upward movement of sub 196. The drill string continues to be raised until pins 52 approach the uppermost ends 252 of slot 247. This is shown in FIG. 20. At this point, sub 196 and the bottom portion of the core sample have been raised above flap member 91. Thus, there is nothing to restrain the flap member in its deflected, unstable configuration. Consequently, the flap member can spring into a planar configuration, pivot and fall into engagement with shoulder 220. This is shown in FIGS. 20 and 14. The flap member is prevented from moving upwardly with the core sample and sub 196 by leash 230 which secures the flap member to flap-valve housing 202. The leash exerts tension on the flap member and thereby insures that the flap member pivots in the manner of a trap-door and comes to rest on shoulder 220. Flap member 91 is then in its planar configuration (FIG. 15) and in position to seal the sample chamber 84.

It should be noted that only a minimal amount of drilling fluid can enter sample chamber 84 during coring since the clearance between shoulder 220 and core bit 66 is minimal. Much of the fluid which does enter the chamber is ultimately displaced by the core sample; however, the core chamber 84 is sized with respect to the core bit opening to enable the core to move easily into the chamber and necessarily an amount of drilling fluid remains in the chamber after the core is received therein.

If the drill string is raised to a point at which pins 52 reach the upper ends 252 of J-slots 247, further upward movement of the drill will lift lower barrel section 46 from the bottom of the core hole. During this time the relative position of lower transfer tube 82A to bearing 112 and thereby upper barrel section 48 remains constant. Since spring 122 continues to bias the transfer tube 82A downwardly, nut 106 continues to bear upon bearing 112. Therefore, the point of dart 188 remains spaced apart from puncturable seal 184 and expansion chamber 180 remains sealed.

Having recieved the core sample into sample chamber 84 and having closed flap member 91, lowering of the drill string is commenced. Accordingly pins 52 travel downwardly with respect to slots 247.

Referring to FIG. 21, the sample chamber is sealed by lowering the drill string to move pins 52 of the upper core barrel axially downwardly in slots 247. This moves sample chamber sub 196 and the core sample downwardly with respect to the lower core barrel (core bit sub 62). Since flap-valve housing 202 is restrained from axial movement by ring latch 206 which has expanded in annular slot 209, the flap-valve housing remains in the elevated position shown in FIGS. 18–21. Accordingly, the sample chamber sub moves downwardly relative to the flap-valve housing 202 until core catcher sub 198 abuts flap member 91 (FIG. 21). Sub 198 abuts the resilient base portion 222 of the flap member and thereby seals the sample chamber thereby.

Referring to FIGS. 17 and 21, when core chamber sub 198 abuts the flap member, downward movement of the core chamber sub is prevented since the flap-valve housing 202 continues to be retained by latch ring 206 engaged in annular slot 209 of the outer core barrel. Further downward movement of the drill string after the core chamber sub 198 abuts the flap member results in relative motion between transfer tub 82A which is stationary and upper core barrel 48. Thus, as the upper core barrel 48 continues to descend, spring 122 is further compressed along stationary transfer tube 82A. As spring 122 is further compressed by the downward movement of the upper core barrel applied to the upper portion of the spring by spring seat 108, the closing force applied to the flap member is increased. As a result, bearing 112 is lowered with respect to adjustment nut 106 which is engaged to stationary transfer tube 82A (FIG. 7). The continuing downward movement of upper core barrel causes upper transfer tube 82B to move downwardly while the lower transfer tube 82A remains stationary. As a result, sealing disc 184 is moved downwardly until it strikes and is pierced by dart 188. In this way the seal to the expansion chamber 80 is broken and fluids are permitted to pass from the sample chamber 84, through transfer tubes 82A and 82B, and into the expansion chamber only after the flap member has sealed the sample chamber.

At this point, pins 52 are approaching the lower end of each of axial slots 247. When the pins 52 reach the bottom of slots 247, the drill string is rotated in a clockwise direction to move pins 52 along circumferential slot 248 until the pins are positioned in axial slot 246. When the drill string is thereafter lifted and the core barrel is lifted therewith toward the surface, pins 52 become engaged in the uppermost ends 250 of axial slots 246. Accordingly spring 122 remains compressed and the flap member remains clamped thereby to enhance its seal.

The expansion chamber 80 and sample chamber 84 are connected to one another and sealed prior to being moved upwardly toward the surface. Therefore, as the core barrel is raised to the surface, differential pressure between the interior of the sealed chambers and the exterior is formed since the exterior pressure decreases as the core barrel is raised. Fluids are free to move upwardly through the transfer tubes 82A and 82B and valve 128 into expansion chamber 80. As the core barrel is progressively lifted toward the surface, the compressible fluids (the gases and vapors) tend to expand chamber 80 as the external pressure decreases. Since membrane 156 is radially and axially expandable, the decreasing external pressure enables the gases to expand and cause the membrane or wall of the expansion chamber to deflect or stretch radially outwardly. Once the membrane is expanded to its radial limit or against the inner surface of housing 72, terminal 86 commences to be forced axially upwardly. Guide assembly 94 together with valves 144, 146 and terminal 86 are free to move axially upwardly within upper valve housing 42. As pressure is reduced, the gases being expanded can expand to an extent at which the expansion chamber can become taut in the radial direction. If this occurs, thereafter pressure within the expansion chamber will commence to increase. As a result, movement of the assembly stretches membrane 156 in the axial direction. The membrane commences to stretch axially when the core chamber is a few hundred feet from the surface, thereby maintaining a low or essentially no pressure differential as the chambers approach the surface. Releif valve 146 is provided to insure that the pressure does not exceed a predetermined value. When the core barrel reaches the surface, the pressure within the expansion chamber can be maintained at a relatively low level, such for example, a few hundred pounds per square inch. Thus, there is no danger in handling the core barrel since it is has relatively low internal pressure. The entire sample remains sealed in the core barrel including gases, liquids and solids. At the surface, the core barrel can be disassembled by removing upper valve housing 42 therefrom. This exposes valve 144 through which the gases and liquids may be removed from the expansion chamber. The solid core sample can be removed by disassembling the remainder of the core barrel.

Providing a sealed sample chamber in which the differential pressure is maintained at essentially zero until the core barrel is close to the surface, insures that there is no leakage of the sample fluids during movement to the surface. This is extremely advantageous in that not only is all of the sample retained, but it also obviates the need for valves and other structure capable of withstanding differential pressures which may be in the order of 10,000 pounds per square inch or more. Since a small clearance is provided between shoulder 220 and the core bit, since the sized diameters of the sample chamber and core bit opening maintains a small clearance with the core sample, and since the expansion chamber is sealed during coring, a relatively limited amount of drilling fluid enters the sample chamber and even less is retained therein. Thus, then is little or no displacement of gases from the core sample by the drilling fluid. Additionally, little or no drilling fluid enters the expansion chamber. Essentially the entire volume of the expansion chamber is occupied by the sample fluids to the exclusion of drilling fluid. Also the sample contains only a negligible quantity of drilling fluid. The provision of a flexible flap member for the flap-valve enables the flap member to be stored in a minimum amount of space and consequently the opening into the sample chamber can be made relatively larger.

In an embodiment of the core barrel apparatus, the core barrel and drill string outer diameter can be approximately $6\frac{7}{8}$ inches. The drill string can be rotated at about 40 RPM to about 100 RPM to obtain a core sample. Additionally, the core barrel may be used to obtain a sample 20 feet in length or greater at a time.

When the core barrel assembly is introduced into a bore hole, it is possible that unwanted air can be trapped within inner core barrel 78 and within the passage of transfer tube 82A up to the location of seal 184. Thus, when the opening of core bit 66 is lowered into drilling mud, air becomes trapped. The trapped air interferes with the amount of gas and vapor that can be obtained at the bottom hole conditions of the bore hole. The reason for this is that upon puncturing 184, the trapped air which has been compressed to bottom hole conditions enters expansion chamber 80. Accordingly, the expansion chamber must recieve a compressed volume of trapped air along with a compressed volume of bore hole gases and vapors. In addition to reducing the amount of gas and vapor related to bottom hole conditions which can be obtained, the trapped air can contaminate the core sample also being obtained.

To prevent the trapping of air, a flexible tube or hose is extended along the length of the core barrel assembly with the lower end portion of the tube disposed within the interior of the assembly, that is, extending through the opening of core bit 66, through inner core barrel 78, and through the opening of transfer tube 82A to the lower portion of dart 188. With the tube in place and the upper end portion of the tube open, the core barrel assembly is lowered into the drilling mud composition in the bore hole. Due to the venting action of the tube, air is released from the inner core barrel and the transfer tube as the mud composition enters the inner core barrel and ultimately the transfer tube. By way of example, lowering the assembly approximately 20 feet into the drilling mud composition at the surface portion of the bore hole can be suffiicent to enable the mud composition to displace all air from the interior of the inner core barrel and transfer tube. As a result, there is no air available to enter the expansion chamber at the bottom hole conditions when the seal is broken to obtain the gas and vapor sample.

Another method of preventing the trapping of air within the inner core barrel is to pre-fill the inner core barrel and the transfer tube below the seal with a material which does not interfere with the gas sample to be admitted into the expansion chamber. For example, the inner core barrel and the lower portion of the transfer tube can be filled with water, a drilling mud composition, or other material compatible with the samples to be obtained and yet capable of displacing air from the assembly. The filling material such as water or mud composition can be sealed at the opening of core bit 66 by a suitable membrane or film which is adapted to be ruptured once the assembly is submerged into the mud in the bore hole. For example, a film of resin material can serve as a membrane for temporarily closing the opening of the core bit in order to maintain water or mud composition within the interior of the assembly.

During the taking of a core sample, the drilling mud can be at a pressure greater than the pressure at the bottom hole condition due to the pressure drop resulting from the passage of drilling mud through the openings in guide assemblies 94 and 96, axial bores 116 and the annular passage extending between housing 60 and upper barrel 190 and core bit sub and sub 196. The result is that the increased pressure of the drilling mud over that of the pressure at the bottom of the bore hole when a core is being taken and while the core is extending into the inner core barrel can result in the over-pressured mud composition penetrating and saturating the surface area of the core adjacent thereto. As a result, the core can be saturated with the mud composition and the mud composition can force away gases and vapors at bottom hole conditions which would otherwise be sampled. To overcome this possibility by which the over-pressured mud composition can penetrate the core, the inner core barrel can be filled at the surface with an inert fluid or liquid which is adapted to seal in the sides of the core extending into inner core barrel 78. By way of example, water can serve as the inert fluid within the inner core barrel. It is preferred to utilize an inert fluid other than water and especially an inert fluid which is adpated to penetrate the surface of the core sample. As in the case of preventing the trapping of air in the inner core barrel by filling it with water or drilling mud composition, the inert fluid for preventing the penetration of the core by drilling mud can be retained within the inner core barrel by a puncturable diaphragm such as one formed by resin film material.

What is claimed is:

1. Pressure core barrel apparatus adapted to be connected to a drill string for retrieving a core sample including solids and fluids cored from a bore hole extending into a subterranean formation comprising:

a first chamber having an opening for receiving the sample;

means for selectively sealing the opening of the first chamber after a core sample has been received in the first chamber;

a second expansible closed chamber disposed adjacent the first chamber for receiving in the interior thereof fluids from the core sample in said first chamber, the exterior of the second chamber when disposed in a bore hole being exposed to the ambient condition of the bore hole adjacent thereto;

means for selectively connecting said expansible chamber with said first chamber to enable fluids from the first chamber to enter the second chamber; and means for remotely actuating the connecting means to connect the second chamber to the first chamber.

2. Pressure core barrel apparatus in accordance with claim 1 and further comprising means for remotely operating the sealing means for selectively sealing the opening in the first chamber.

3. Pressure core barrel apparatus in accordance with claim 1 in which the second expansible chamber comprises a tube having wells of substantially thick resilient material.

4. Pressure core barrel apparatus in accordance with claim 1 in which the second expansible chamber comprises an elongated fluid-tight membrane which is longitudinally expansible.

5. Pressure core barrel apparatus in accordance with with claim 1 in which the first chamber is an elongated cylinder having the opening thereof at the lower end portion of the cylinder, the upper end portion of the cylinder being connected to the second chamber.

6. Pressure core barrel apparatus in accordance with claim 5 in which the sealing means in the operative position thereof extends across the opening in the lower end portion of the first chamber and closes the opening.

7. Pressure core barrel apparatus in accordance with claim 1 comprising an outer core barrel enlosing said chambers, said outer core barrel being adapted to be connected to the drill string for driving the pressure core barrel in the bore hole.

8. Pressure core barrel apparatus in accordance with claim 7 in which the second expansible chamber is elongated and has a first end portion and a second end portion, one of said end portions being fixed in the outer core barrel and the other end portion being movable within the core barrel in response to the expansion thereof.

9. Pressure core barrel apparatus in accordance with claim 8 in which said first and second end portions comprise cylindrical members disposed within the outer core barrel with each having the longitudinal axis thereof extending along the longitudinal axis of the outer core barrel and in which the second expansible chamber comprises an elongated sleeve of elastic material attached at each opposite ends thereof to a different one of said first and second end portions.

10. Pressure core barrel apparatus in accordance with claim 1 in which the second expansible chamber comprises an hose.

11. Pressure core barrel apparatus in accordance with claim 10 in which the hose is a fabric hose having an impervious flexible coating.

12. Pressure core barrel apparatus in accordance with claim 1 in which said means for selectively connecting said expansible chamber with said first chamber comprises a conduit extending between the first and second chambers and sealing means adapted to be actuated by the actuating means for opening the sealing means.

13. Pressure core barrel apparatus in accordance with claim 12 in which the sealing means comprises a puncturable member disposed in the conduit and adapted to be punctured by the actuating means.

14. Pressure core barrel apparatus in accordance with claim 13 in which the puncturable member comprises a thin disc disposed in the conduit.

15. Pressure core barrel apparatus in accordance with claim 1 in which said means for selectively sealing the opening of the first chamber comprises a valve including a flexible valve member adapted to be flexed in the open position of the valve to conform to and be stored adjacent the inner surface of the first chamber and the opening thereof.

16. Pressure core barrel apparatus in accordance with claim 15 in which said flexible valve member comprises resilient, fluid-sealing base means and flexible, load-supporting means in superposition at least in part with said base means, and in which the first chamber includes an annular valve seat adjacent the opening and facing the interior of the first chamber, the valve seat being adapted to be engaged by the valve member in a fluid-tight manner and support said load-supporting means thereon when said flexible valve member is unflexed and positioned on said seat in the closed position of the valve.

17. Pressure core barrel apparatus in accordance with claim 16, in which said base member comprises a disc-like member and in which said load-supporting means comprises a plurality of juxtaposed bars extending parallel to the plane of the disc-like member and being adapted to extend in the direction of the longitudinal axis of the first chamber when the valve member is flexed and in its open position.

18. A flexible valve member comprising resilient, fluid-sealing base means in the form of a disc, an annular portion of one face of the disc being adapted to engage an annular valve seat adjacent an opening to be closed by the valve member, the valve member further comprising flexible, load-supporting means disposed adjacent the one face of the disc and comprising a plurality of elongated load-supporting members extending substantially parallel to one another across the one face of the disc and being operative to bear upon the annular valve seat to support a load applied to the opposite face of the disc in an unflexed, sealing configuration of said valve member with the load-supporting members being adapted to bridge the valve opening, the entire valve member being flexible about an axis which is parallel to one of said load-supporting members whereby the valve member may be flexed to conform to a predetermined flexed non-sealing configuration.

19. A flexible valve member comprising resilient, fluid-sealing base means in the form of a disc which is adapted to engage an annular valve seat adjacent an opening to be closed by the valve member, the valve member further comprising flexible, load-supporting means in superposition at least in part with said base means comprising a plurality of juxtaposed members extending parallel to the plane of the disc-like base means adaptable to extend in a common direction when the valve member is flexed about an axis extending in the common direction, whereby the entire valve member is flexible to conform to a predetermined flexed configuration.

20. A flexible valve member in accordance with claim 19 in which the juxtaposed members comprise bars operatively secured to said base means.

21. A flexible valve member in accordance with claim 20 in which said bars comprise a flanged section extending parallel to the axis of flexure and in which said base member has a plurality of parallel grooves in one surface thereof in which are disposed flanged section of said bars.

22. A flexible valve member in accordance with claim 21 in which said flanged section and said grooves are continuous along a substantial length extending parallel to the axis of flexure.

23. A valve for sealing a core barrel in which a sample of a subterranean formation is retrieved comprising an annular valve seat adjacent an opening and a flexible valve member having resilient fluid-sealing base means in the form of a disc, an annular portion of one face of the disc being adapted to sealingly engage the valve seat, and flexible load-supporting means disposed adjacent one face of the disc and comprising a plurality of elongated members extending substantially parallel to one another across the one face of the disc and being operative to bear upon the annular valve seat to support a load applied to the opposite face of the disc in an unflexed, sealing configuration of said valve member with the load-supporting members bridging the valve opening, the entire valve member being flexible about a flexure axis which is parallel to one of the load-supporting members to conform to a predetermined flexed configuration in which the load-supporting members extend substantially parallel to the axis of the core barrel, the valve member being adapted to being pivoted from the flexed configuration in which the load-supporting members extend substantially parallel to the core barrel axis to the sealing configuration in which the load-supporting members bridge the valve opening.

24. A valve for sealing a core barrel in which a sample of a subterranean formation is retrieved comprising a valve seat adjacent an opening in the core barrel and a flexible valve member having resilient fluid sealing base means and flexible load-supporting means in superposition at least in part with said base means, the entire valve member being adapted to be flexed about a flexure axis to conform to a predetermined flexed configuration, said valve member being adapted to engage said valve seat and close said opening to seal the core barrel thereat, said valve member being operative to be flexed to conform to an inner periphery portion of the core barrel to open said opening, said valve seat comprising a shoulder and said load-supporting means being in super-position at least in part with said shoulder when said valve member closes said opening.

25. A pressure barrel for obtaining and retieving a sample of a subterranean formation comprising:

an outer core barrel including means for drilling in subterrianean formations to form a cored sample; and an inner core barrel enclosed by said outer core barrel comprising a first chamber for receiving the cored sample, said first chamber including means for sealing the chamber at one end thereof, a second, expansible chamber for receiving fluids from the sample, and means for selectively communicating said expansible chamber with said first chamber.

26. A pressure core barrel in accordance with claim 25 in which said outer core barrel comprises an upper section and a lower section, said upper section being adapted to be rotated from the surface of a bore hole, and joint means for transmitting torque applied to said upper section to said lower section and permitting limited relative axial movement between said sections.

27. A pressure core barrel in accordance with claim 26 and futher comprising means for permitting limited relative axial movement between said inner and outer core barrels.

28. A pressure core barrel in accordance with claim 26 and further comprising means for providing limited relative axial movement between said first and second chambers.

29. A pressure core barrel in accordance with claim 26 in which said joint means includes means for selectively permitting limited relative radial movement between said upper and lower sections.

30. A pressure core barrel in accordance with claim 29 and further comprising means for permitting relative rotation between said inner and outer core barrels.

31. A pressure core barrel in accordance with claim 26 in which said joint means comprises pin means movable in slot means, said pin means being secured to one of said upper and lower sections and said slot means being disposed in the other.

32. A pressure core barrel in accordance with claim 31 in which said slot means comprises two axially disposed parallel slots of different length connected by a transverse slot.

33. A pressure core barrel of claim 31 in accordance with which said slot means comprises a generally J-shaped slot.

34. A pressure barrel of claim 25, in accordance with claim 28, wherein said means for selectively communicating said expansible chamber with said first chamber comprises sealing means including selectively operable means for opening said sealing means.

35. A pressure core barrel in accordance with claim 34 in which said sealing means blocks communication between said chambers and said selectively operable means opens said sealing means upon actuation thereof by predetermined relative axial movement of said inner and outer core barrels.

36. A method of obtaining and retrieving a sample of a subterranean formation in a core barrel having a first sample chamber and a second expansible chamber, comprising the steps of:

sealing the second chamber fluid-tight, lowering the core barrel into a subterranean formation while the second chamber is sealed fluid-tight, obtaining the sample in the first chamber while the second chamber is sealed fluid-tight and out of communication with the first chamber, sealing the first chamber with the sample therein, connecting the first and second chambers into communication with one another to permit fluids of the sample to enter the second chamber, raising the core barrel to the surface while enabling the second chamber to expand in response to the pressure of fluids of the sample therein as the core barrel is raised to the surface.

37. A method for retrieving a core sample including solids and fluids thereof from a bore hole by use of a pressure core barrel apparatus having a first chamber with an opening for receiving the sample, means for selectively sealing the opening of the first chamber after a core sample has been received in the first chamber and a second expansible closed chamber disposed adjacent the first chamber for receiving in the interior thereof fluids from the core sample in said first chamber, the exterior of the second chamber when disposed in a bore hole being exposed to the ambient condition of the bore hole adjacent thereto and means for selectively connecting the second expansible chamber with the first chamber to enable fluids from the first chamber to enter the second chamber, the method comprising the steps of:

extending a conduit from within the opening of the first chamber upwardly with respect to the pressure core barrel apparatus;

placing the first chamber in a bore hole containing drilling fluid until the opening of the first chamber is submerged beneath the drilling fluid while the conduit extends from within the first chamber upwardly with respect to the bore hole to vent the interior of the first chamber as the pressure core barrel apparatus is lowered within the bore hole;

removing the conduit upon completing of the venting of the first chamber;

lowering the pressure core barrel apparatus to adjacent the bottom of the bore hole;

receiving the core sample into a first chamber;

sealing the first chamber after the sample has been received therein;

providing a second expansible closed chamber adjacent the first chamber;

connecting the second expansible chamber to the first chamber to enable fluids from the first chamber to enter the second chamber;

raising the first chamber and the second chamber connected thereto toward the surface; and permitting the second chamber to expand while being raised in response to the pressure of fluids therein.

38. A method for retrieving a core sample including solids and fluids thereof from a bore hole by use of a pressure core barrel apparatus having a first chamber with an opening for receiving the sample, means for selectively sealing the opening of the first chamber after a core sample has been received in the first chamber and a second expansible closed chamber disposed adjacent the first chamber for receiving in the interior thereof fluids from the core sample in said first chamber, the exterior of the second chamber when disposed in a bore hole being exposed to the ambient condition of the bore hole adjacent thereto and means for selectively connecting the second expansible chamber with the first chamber to enable fluids from the first chamber to enter the second chamber, the method comprising the steps of:

sealing the interior of the first chamber with a substance to displace air from the interior of the first chamber, the substance being compatible with the solids and fluids of the core sample being obtained to prevent contamination of the sample;

providing a puncturable barrier adjacent the opening of the first chamber to retain the substance therein;

extending a conduit from within the opening of the first chamber upwardly with respect to the pressure core barrel apparatus;

placing the first chamber in a bore hole containing drilling fluid until the opening of the first chamber is submerged beneath the drilling fluid while the conduit extends from within the first chamber upwardly with respect to the bore hole to vent the interior of the first chamber as the pressure core barrel apparatus is lowered within the bore hole;

removing the conduit upon completing of the venting of the first chamber;

lowering the pressure core barrel apparatus to adjacent the bottom of the bore hole;

receiving the core sample into a first chamber;

sealing the first chamber after the sample has been received therein;

providing a second expansible closed chamber adjacent the first chamber;

connecting the second expansible chamber to the first chamber to enable fluids from the first chamber to enter the second chamber;

raising the first chamber and the second chamber connected thereto toward the surface; and permitting the second chamber to expand while being raised in response to the pressure of fluids therein.

39. A method for retrieving a core sample in accordance with claim 38 in which the step of sealing the interior of the first chamber with a substance to displace air from the interior of the first chamber comprises sealing the interior of the first chamber with a fluid.

40. A method for retrieving a core sample in accordance with claim 38 in which the step of sealing the interior of the first chamber with a substance to displace air from the interior of the first chamber comprises sealing the interior of the first chamber with a drilling composition.

* * * * *

UNITED STATES PATENT AND TRADEMARK OFFICE

CERTIFICATE OF CORRECTION

PATENT NO. : 4,142,594

DATED : March 6, 1979

INVENTOR(S) : Charles M. Thompson, et al.

It is certified that error appears in the above-identified patent and that said Letters Patent are hereby corrected as shown below:

Column 1, line 26, delete "relative" and insert --relatively--

Column 2, line 40, delete "are" and insert --is--

Column 3, line 32, after "further," insert --radial--

Column 9, line 44, delete "is" and insert --its--

Column 10, line 34, delete "trucated" and insert "truncated--

Column 12, line 45, delete "with" and insert --within--

Column 14, line 67, delete "recieved" and insert --received--

Column 16, line 23, after "it" delete "is"

Column 16, line 47, delete "then" and insert --there--

Column 17, line 4, after "puncturing" insert --seal--

Column 17, line 7, delete "recieve" and insert --receive--

Column 17, line 28, delete "suffiicent" and insert --sufficient--

Column 19, line 14, delete "an" and insert --a--

Column 21, line 8, delete "retieving" and insert --retrieving--

UNITED STATES PATENT AND TRADEMARK OFFICE

CERTIFICATE OF CORRECTION

PATENT NO. : 4,142,594

DATED : March 6, 1979

INVENTOR(S) : Charles M. Thompson et al.

It is certified that error appears in the above-identified patent and that said Letters Patent are hereby corrected as shown below:

Column 21, line 11, delete "subterrianean" and insert -- subterranean --.

Signed and Sealed this

*Eighteenth* Day of *September 1979*

[SEAL]

*Attest:*

*Attesting Officer*

LUTRELLE F. PARKER

*Acting Commissioner of Patents and Trademarks*